US011858601B2

(12) United States Patent
Dinninger et al.

(10) Patent No.: US 11,858,601 B2
(45) Date of Patent: Jan. 2, 2024

(54) VARIABLE USE PONTOON BOAT SYSTEM AND METHOD

(71) Applicant: Avalon & Tahoe MFG., Inc., Alma, MI (US)

(72) Inventors: Duane Nicholas Dinninger, Rockford, MI (US); Greg Ryan Boyd, Coral, MI (US); Kris Douglas Forrest, San Martin, CA (US)

(73) Assignee: Avalon & Tahoe Mfg., Inc., Alma, MI (US)

( * ) Notice: Subject to any disclaimer, the term of this patent is extended or adjusted under 35 U.S.C. 154(b) by 29 days.

(21) Appl. No.: 16/939,712

(22) Filed: Jul. 27, 2020

(65) Prior Publication Data

US 2021/0024183 A1 Jan. 28, 2021

Related U.S. Application Data

(60) Provisional application No. 62/879,141, filed on Jul. 26, 2019, provisional application No. 62/879,136, filed on Jul. 26, 2019.

(51) Int. Cl.

| | |
|---|---|
| ***B63B 34/75*** | (2020.01) |
| ***B63B 1/12*** | (2006.01) |
| ***B63B 1/20*** | (2006.01) |

(52) U.S. Cl.

CPC ..... *B63B 34/75* (2020.02); *B63B 1/121* (2013.01); *B63B 2001/206* (2013.01)

(58) Field of Classification Search

CPC .. B63B 1/10; B63B 1/12; B63B 1/121; B63B 2001/206; B63B 34/70; B63B 34/75

USPC ..... 114/284, 285; 701/21

See application file for complete search history.

(56) References Cited

U.S. PATENT DOCUMENTS

| | | | | |
|---|---|---|---|---|
| 9,067,644 | B2 * | 6/2015 | Sheedy | B63B 34/75 |
| 9,174,703 | B2 * | 11/2015 | Sheedy | B63B 1/22 |
| 9,446,823 | B2 * | 9/2016 | Sheedy | B63B 1/20 |
| 9,573,655 | B1 | 2/2017 | Pigeon | |
| 10,308,321 | B1 * | 6/2019 | Miller | B63B 1/32 |
| 10,745,084 | B2 * | 8/2020 | Forrest | B63B 1/32 |
| 2002/0073909 | A1 | 6/2002 | Liston et al. | |
| 2008/0271660 | A1 | 11/2008 | Zsido et al. | |

(Continued)

*Primary Examiner* — Daniel V Venne

(74) *Attorney, Agent, or Firm* — Robert L. Stearns; Dickinson Wright PLLC

(57) ABSTRACT

A variable use pontoon boat configured to operate in both a high speed condition and an improved wake-profile condition is provided. The boat includes a pair of outer pontoons that flare outward in the rearward direction. A rear section of the outer pontoons has a width that is greater than its height. An inclined bottom surface is defined by the outer pontoons. The bottom surface is inclined upward in the rearward direction, and may be inclined laterally upward. The system may include a center pontoon that flares outward in the rearward direction. The center pontoon and the outer pontoons may be spaced apart at a decreased distance at the rear of the boat relative to the front of the boat, such that water is blocked at the rear of the boat and displaced downward. A pair of wake panels may be disposed at the rear of the outer pontoons, and the wake panels may be individually and selectively actuated downward into the water to enhance the wake profile and retracted upward at high speeds.

27 Claims, 14 Drawing Sheets

(56) References Cited

U.S. PATENT DOCUMENTS

| | | | |
|---|---|---|---|
| 2017/0217544 | A1 | 8/2017 | Sheedy et al. |
| 2019/0210694 | A1 | 7/2019 | Forrest et al. |

* cited by examiner

VARIABLE USE PONTOON BOAT SYSTEM AND METHOD

CROSS-REFERENCE TO RELATED APPLICATIONS

This application claims the benefit of previously filed U.S. Provisional Application No. 62/879,136, filed Jul. 26, 2019, and U.S. Provisional Application No. 62/879,141, filed Jul. 26, 2020, the entire content of which are hereby incorporated by reference in their entirety.

FIELD OF THE INVENTION

The present disclosure relates to pontoon boats, and more particularly to the shape and function of the pontoon floats at low and high speeds.

BACKGROUND

Recreational marine vessels are in common use and include a variety of boat types directed to different recreational activities. For example, there are recreational boats tailored for speed and for towing a water-skier or for towing an inflatable device at a generally high speed. Another type of boat is a wake-boat or wake creating boat, that has a specific hull and transom shape that produces a surfable wake behind the boat, allowing for wake surfing or wake boarding, in which a user is towed behind the boat, similar to a speed boat, and the wake boarder or wake surfer may direct themselves toward the wake pattern created by the boat. Wake boats typically operate at a slower speed than a speedboat that tows a water skier.

Pontoon boats are in common use as a leisure boat or pleasure craft capable of carrying a relatively large number of passengers. Pontoon boats may travel at various speeds, but are often utilized at slower speeds, such as cruising speeds, where the passengers may enjoy a relatively stable boat position at a variety of speeds. Pontoon boats may include multiple pontoons or "pontoon floats" that float on the water, with the pontoons supporting a platform on which the passengers are carried. Unlike a traditional boat hull, the pontoons will define an open area laterally between them, with the platform supported on top of the pontoons and above the open area.

Pontoon boats may be utilized at higher speeds and may be able to operate to tow an inflatable or other similar device behind the boat, but are typically less efficient that other watercraft.

Accordingly, there are different boat styles directed to different types of recreational activity. Due to expense and/or storage limitations, consumers may typically choose a boat style directed to their primary recreational activity. However, in choosing such a boat style, consumers may be limited in other types of recreational activity. In some cases, a consumer may have to purchase more than one type of boat in order to be able to enjoy all of the recreational activities that they desire. For example, a consumer may desire the more relaxed recreational benefits of a pontoon boat, but may also desire the benefits of a speed boat or wake boat to enable wake surfing or water skiing. In this case, the consumer is forced to purchase more than one boat or is forced to compromise on the type of boat they choose, foregoing the benefits of another boat style.

Pontoon boats are particularly popular in that they provide many recreational benefits and are capable of carrying a large number of passengers, which is desirable in many social settings. However, the wake pattern provided by the traditional pontoon boat is unsatisfactory for users interested in wake surfing or wake boarding, because the wake pattern is inconsistent and generally small.

A desirable wake characteristic for wake surfing and wakeboarding includes the shape, the height, and energy of the wake pattern that is created. A wake boat can produce a large wake pattern, both in shape and height, enabling a maximization of tricks and other maneuvers that can be performed. Pontoon boats are typically designed to produce small wakes, which are undesirable for wake boarding or wake surfing enthusiasts. Additionally, pontoon boats do not include a transom like wake boats.

In view of the above, improvements can be made to recreational marine vessels.

SUMMARY

In one aspect, a pontoon boat is provided. The pontoon boat includes: a deck; at least two pontoon floats supporting the deck and creating trailing wakes when the boat is propelled across a body of water; at least one wake panel supported off the stern end of at least one of the pontoon floats for pivotal and/or translational movement between an upward stowed positon, in which the wake panel is out of or substantially out of the body of water while the boat is being propelled, and a downwardly deployed position, in which at least a lower part of the at least one wake panel engages the body of water while the boat is being propelled and deflects the flow of water in a manner that alters the size and/or shape of one or both trailing wakes for water sport activities.

In one aspect, the wake panel is supported for pivotal movement between the upward stowed and downwardly deployed positions.

In one aspect, the wake panel is supported for translational movement between the upward stowed and downwardly deployed positions.

In one aspect, the translational movement is sliding movement.

In one aspect, the at least one wake panel comprises at least two wake panels.

In one aspect, each of the at least two pontoon floats supports an associated one of the at least two wake panels.

In one aspect, the wake panels are angled forwardly in a direction from top to bottom.

In one aspect, the forward angle approximates an angle of a rear face of the pontoon float on which each respective one wake panel is mounted.

In one aspect, support for the wake panels includes at least one mounting rail secured to each respective pontoon float.

In one aspect, the wake panels are slotted in the sliding direction.

In one aspect, the wake panels each have a lower edge portions formed with a respective rearward extending lower flange.

In one aspect, the lower flange forms an obtuse angle with a body portion of the respective wake panel.

In one aspect, the lower flange has a convex curved rear edge.

In one aspect, the wake panels further include outboard edge portions formed with a respective rearwardly extending outboard flange.

In one aspect, the outboard flange forms an obtuse angle with the body portion of the respective wake panel.

In one aspect, the obtuse angle of the lower flange is greater than the obtuse angle of the outboard tab.

In one aspect, the wake panels further include inboard edge portions formed with a respective rearwardly extending inboard flange.

In one aspect, the inboard flange forms an angle with the body portion of the respective wake panel that is lesser than the angle of the outboard flange, which is lesser than the angle of the lower flange.

In one aspect, the wake panels further include an upper edge portion formed with an upper flange.

In one aspect, the upper flange extends forwardly of the body portion of the respective wake panel.

In one aspect, the at least two pontoon floats have flat bottom portions adjacent the stern end thereof.

In one aspect, the flat bottom portions are tilted outwardly and defined a tilted plane.

In one aspect, the wake panels are in line with the flat bottom portions.

In one aspect, the at least two pontoons each support an associated wake panel for sliding in a direction perpendicular to the tilted plane of their respective flat bottom portions.

In one aspect, a lower edge of the wake panels are tilted and are generally parallel to the titled plane of the flat bottom portion of the pontoon floats.

In another aspect, a pontoon boat system configured to produce an improved wake profile is provided. The system includes: first and second outer pontoons each having a front end and a rear end and extending longitudinally; a platform separate from and coupled to and supported by the first and second outer pontoons; wherein the first outer pontoon includes a first bottom inclined surface extending forward from the rear end of the first outer pontoon, wherein a front end of the first bottom inclined surface is disposed below a rear end of the first bottom inclined surface; wherein the second outer pontoon includes a second bottom inclined surface extending forward from the rear end of the second pontoon, wherein a front end of the second bottom inclined surface is disposed below a rear end of the second bottom inclined surface; wherein, at the rear end of the first and second outer pontoons outer pontoon, a laterally inner surface of the first outer pontoon is spaced away from a laterally inner surface of the second outer pontoon at a smaller distance relative to the front end of the first and second outer pontoons.

In one aspect, the system includes a pair of wake panels mounted and supported on a rear end of the first and second outer pontoons, wherein the wake panels are mounted for independently actuatable pivotable or slidable translation between a stowed position and a downwardly deployed position, wherein the wake panels are disposed below the surface of the water when the pontoon boat is traveling forward along the water when the wake panels are in the downwardly deployed position.

In one aspect, the system includes a center pontoon disposed laterally between the first and second outer pontoons and extending longitudinally between a front end and a rear end thereof; wherein, at the rear end of the first outer pontoon, a laterally inner surface of the first outer pontoon is spaced away from a first laterally outer surface of the center pontoon at a smaller distance relative to the front end of the first outer pontoon; wherein, at the rear end of the second outer pontoon, a laterally inner surface of the second outer pontoon is spaced away from a second laterally outer surface of the center pontoon at a smaller distance relative to the front end of the second outer pontoon.

In one aspect, the system includes an inboard/outboard forward drive motor.

In one aspect, the first and second outer pontoons are wider at the rear end than the front end and the center pontoon is wider at the rear end than at the front end.

In another aspect, a method of varying a wake profile of a pontoon boat is provided, the method including the steps of: propelling a pontoon boat having two outer pontoon floats that support a separate platform; positioning wake panels attached to the two outer pontoon floats in a deployed position in which the wake panels are downwardly deployed relative to respective bottom inclined surfaces of the outer pontoon floats, wherein a rear end of the bottom inclined surface is disposed above a front end of the bottom inclined surfaces; operating the pontoon boat in a first state in which at least one of the wake panels are positioned in the deployed position; generating a first wake profile when operating the pontoon boat in the first state; positioning the wake panels in a retracted position in which the wake panels are raised relative to the deployed state; operating the pontoon boat in a second state in which the wake panels are positioned in the retracted position; generating a second wake profile when operating the pontoon boat in the second state, wherein the second wake profile is reduced relative to the first wake profile.

In one aspect, one of the wake panels is in the deployed position and one of the wake panels is in the retracted position when operating in the first state.

In one aspect, the bottom inclined surfaces are tilted outwardly.

In yet another aspect, a pontoon boat is provided comprising: a deck having a deck surface disposed in a horizontal plane; a first pontoon float having a generally tubular hollow construction with a closed circumferential wall extending longitudinally between a forward end an opposite rearward end; a second pontoon float having a generally tubular hollow construction with a closed circumferential wall extending longitudinally between a forward end an opposite rearward end; said first and second pontoon floats being separate constructional components from one another and from said deck; said first pontoon float mounted to said deck adjacent one lateral side edge of said deck; said second pontoon float mounted to said deck adjacent an opposite lateral side edge of said deck in laterally spaced relation to said first pontoon float; a forward section of said first pontoon float having a substantially rounded outer profile when viewed in cross-section in a plane perpendicular to said horizontal deck plane; a rearward section of said first pontoon float having a different outer profile including an inclined lower surface portion which is non-parallel with respect to the orientation of said horizontal deck plane, wherein said lower surface portion commences at a leading edge and extends longitudinally to a trailing edge and further extends cross-wise between an inner lateral edge and an outer lateral edge, and wherein said lower surface portion is canted toward said horizontal deck plane in a direction from said forward edge toward said rearward edge and also canted toward said horizontal deck plane in a direction from said inner lateral edge toward said outer lateral edge; said second pontoon float having the same claimed features as that of said first pontoon float and being the mirror image of said first pontoon float with respect to a plane perpendicular to said horizontal deck plane extending longitudinally between said first and second pontoon floats.

In another aspect, the pontoon boat includes including a third pontoon float formed as a separate constructional component from that of said deck and said first and second pontoon floats, said third pontoon float mounted to said deck in position between said first and second pontoon floats.

In another aspect, the pontoon boat may including a translatable and independently actuatable wake panel mounted on each of said first and second pontoon floats adjacent said lower surface portion, wherein said wake panel is downwardly deployable to effect a modified wake profile in the trail of the said first and second pontoon floats.

In another aspect, for each of the above-described aspects, the wake panels may be generally planar but include a bent flange portion adjacent an edge of the wake panel.

DETAILED DESCRIPTION

Figure 1:
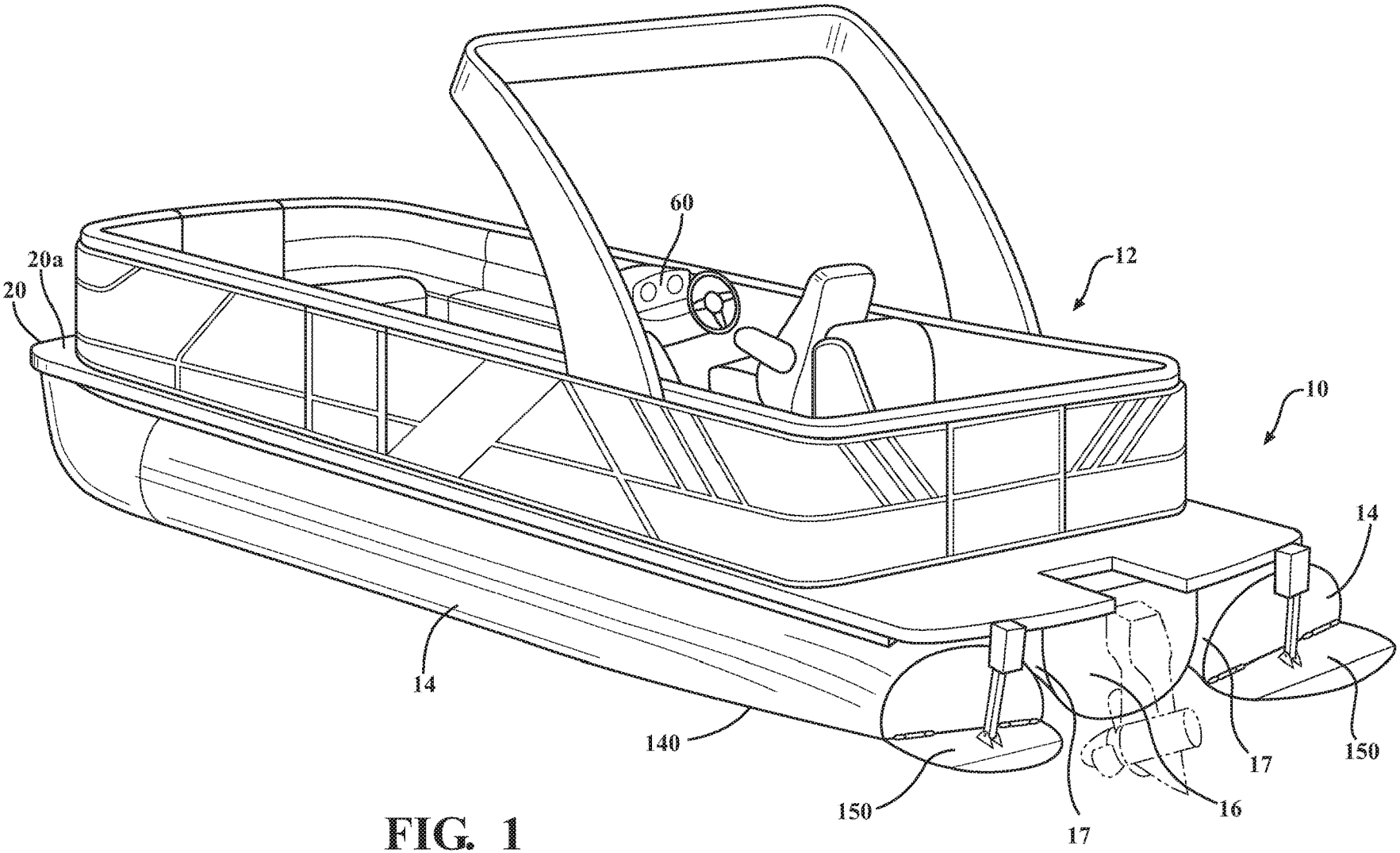
FIG. 1 is a perspective view of a pontoon boat having outer pontoons with a bottom inclined surface and actuatable wake panels extending therefrom.
Figure 2:
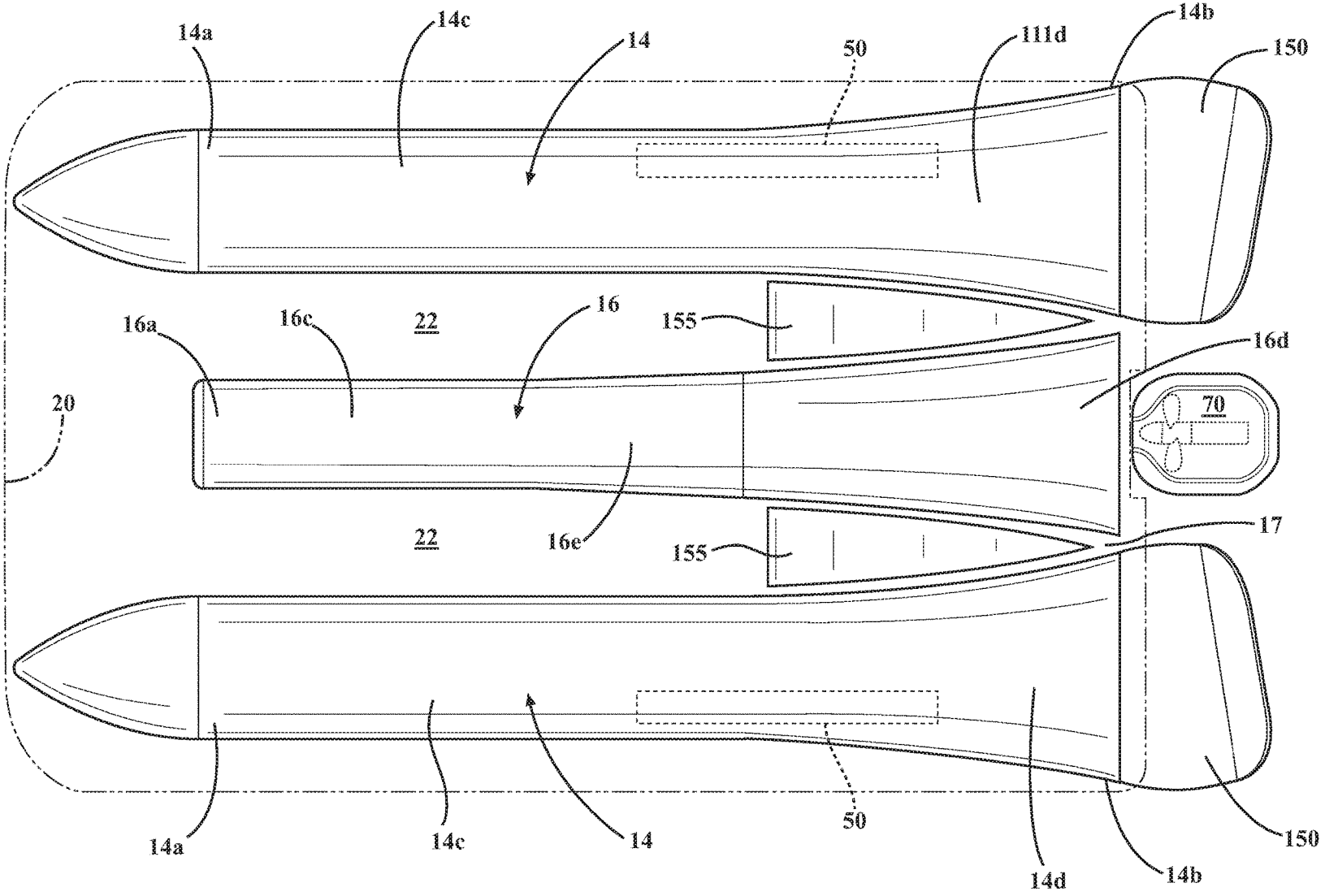
FIG. 2 is a top view of the boat.

With reference to FIGS. 1 and 2, a system 10 for varying the use of a boat 12, in particular a pontoon boat, is provided. The system 10 may include the boat 12, which may include a pair of outer pontoons 14 (which may also be referred to as first and second pontoon floats) and, optionally, a center pontoon 16 (which may also be referred to as a third pontoon float) disposed laterally between the outer pontoons 14. The system 10 may further include additional structure coupled to the boat 12 and the pontoons 14, 16 thereof, as further described below. The outer pontoons 14 and the center pontoon 16 are specifically sized and arranged to direct the water flowing between the pontoons 14, 16 downward rather than allowing the water to flow freely between the pontoons 14, 16 and exiting the rear of the boat 12. The pontoons may also be referred to as pontoon floats.

The outer pontoons 14 may be considered as a pair, or as first and second outer pontoons 14. For the purposes of discussion, the outer pontoons 14 may be referred to jointly as having the same features, or a single outer pontoon 14 may be described. It will be appreciated that a reference or discussion to a single outer pontoon 14 may apply equally to the other outer pontoon 14 unless otherwise noted.

As described above, the pontoons 14, 16 may also be referred to as pontoon floats. The pontoons 14, 16 are hollow structures with an open space that is enclosed by the wall defining the pontoons 14, 16, thereby providing buoyancy. In one aspect, the pontoons are formed of sheet metal. The pontoons 14 are separate structures relative to the platform 20, and are attached to the separate platform 20 via known attachment methods typical for pontoon boats. The center pontoon 16 may not be fully enclosed by its structure, but may be in the form of a U-shaped bent structure that is enclosed at the front and rear ends and bolted or otherwise fastened to the bottom of the platform 20. The pontoon and platform arrangement of the boat 12 is distinguishable from hull-type boats, such as speedboats or the like.

The outer pontoons 14 are spaced apart laterally and extend longitudinally relative to a longitudinal direction of the boat 12, with the center pontoon 16 disposed laterally between the outer pontoons 14. The boat 12 further includes a platform 20 supported by the pontoons 14, 16 off the surface of the water along which the boat 12 travels in use, with the platform 20 being fixed to the pontoons 14, 16 in a traditional manner known in the art, such as by welding, bolting, strapping, or the like. The platform 20 provides a structure for mounting additional boat structure, such as benches or other seating, storage compartments, boat controls, or the like that may be typically disposed on a recreational boat.

The platform 20 includes an upper surface 20*a* and a lower surface 20*b*. The upper surface 20*a* is typically the surface on which the passengers of the boat will sit or stand, and the lower surface 20*b* faces the water. The lower surface 20*b* and the pontoons 14, 16 thereby define an open space 22 above the surface of the water that extends below the platform 20 and between the pontoons 14, 16 when the boat 12 is floating on the water.

As described above, the boat 12 may include the two outer pontoons 14, where the pontoons 14 will be disposed generally laterally symmetrical relative to a longitudinal centerline of the boat 12. Additionally, as described above, the boat 12 may include the center pontoon 16 disposed generally along the longitudinal centerline of the boat 12. In this approach, a pair of open spaces 22 are disposed between the center pontoon 16 and the laterally outer pontoons 14.

The open spaces 22 may also be referred to as a channel or channels. As the boat 12 is traveling on the water, water is displaced by the pontoons 14, 16 into the spaces 22 as well as downward below the pontoons 14, 16 and laterally outward along the sides of the outer pontoons 14. In a traditional pontoon boat, the water that travels within the spaces between the pontoons will simply exit the rear of the pontoon boat. However, the arrangement of the system 10 and the boat 12 as described herein creates a different path of the displaced water.

With reference again to the outer pontoons 14 and the center pontoon 16, and in particular their shape, the pontoons 14, 16 are sized and arranged such that the lateral space between the outer pontoons 14 and the center pontoon 16 is substantially reduced at the rear of the boat 12 relative to a traditional pontoon boat. In particular, the widths of the pontoons 14 and 16 are increased, such that the space between the pontoons 14, 16 is taken up by the additional width, as further described below.

With reference to FIG. 2, which illustrates the pontoons 14 and 16 from a top view looking down, the pontoons 14, 16 flare outward in the rearward direction. The outer pontoons 14 each include a front end 14*a* and a rear end 14*b*. Similarly, the center pontoon 16 includes a front end 16*a* and a rear end 16*b*.

At the front of the boat 12, the space between the pontoons 14 and 16 is larger than the space between the pontoons 14 and 16 at the rear of the boat. Put another way, the lateral width of the pontoons 14 is greater at the rear end 14*b* than at the front end 14*a*. Similarly, the lateral width of the center pontoon 16 is greater at the rear end 16*b* than at the front end 16*a*.

Figure 3:
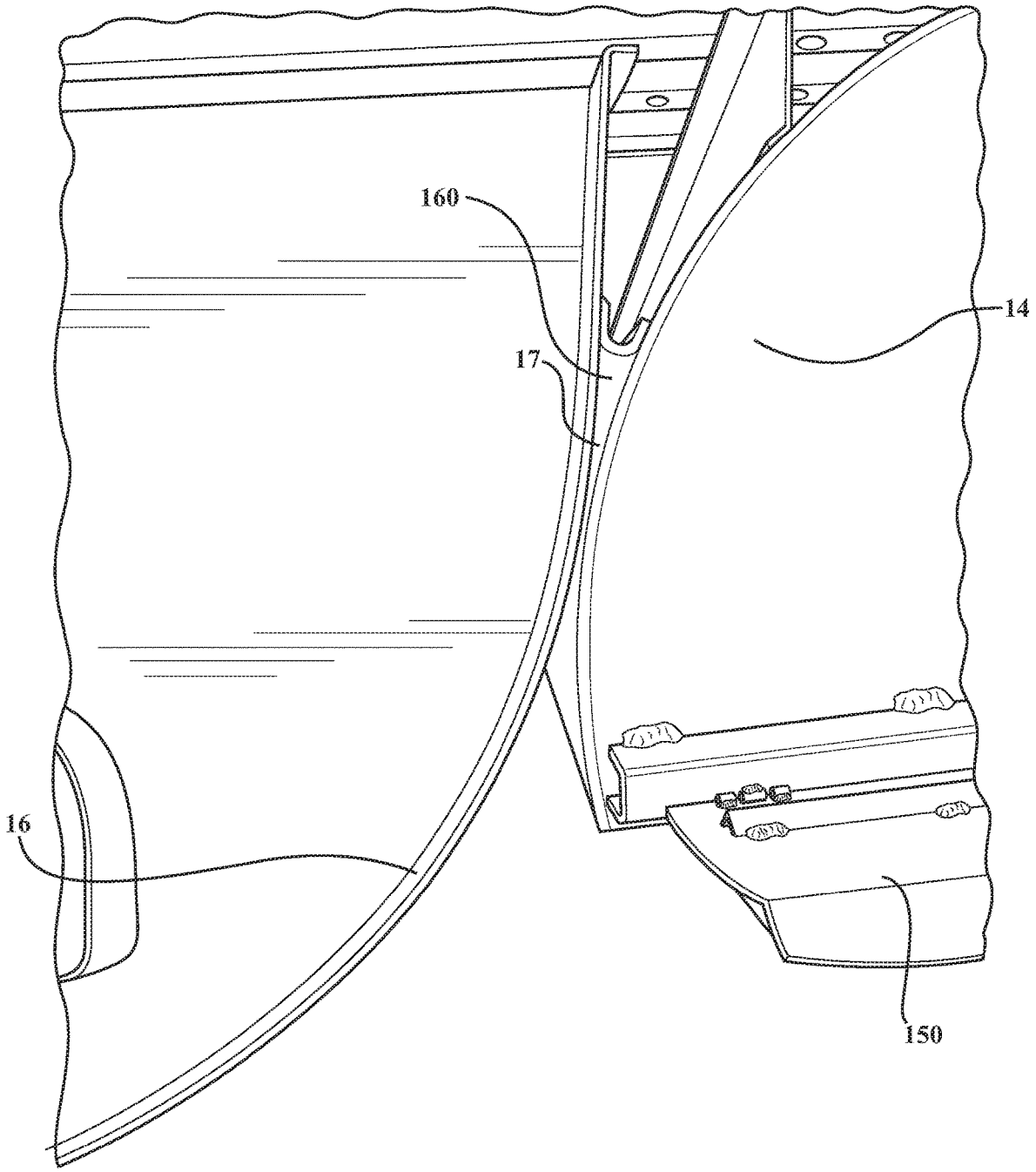
FIG. 3 is a rear view of a decreased lateral space between an outer pontoon and a center pontoon.

In one approach, shown in FIG. 3, at the rear end of the boat 12, the outer pontoons 14 are nearly touching the center pontoon 16 at an "intersection" point 17. Accordingly, the water flowing between the pontoons cannot easily pass between the pontoons 14, 16 and exit through the rear of the boat 12. Rather, the water will be displaced downward below the intersection point 17. Water may also be displaced above the intersection point 17; however, as described in further detail below, a splash panel or deflector piece may be disposed between the outer pontoons 14 and the center pontoon 16 that substantially blocks the upwardly displaced water or splashing water, thereby forcing this water downward below the intersection point 17.

Figure 4:
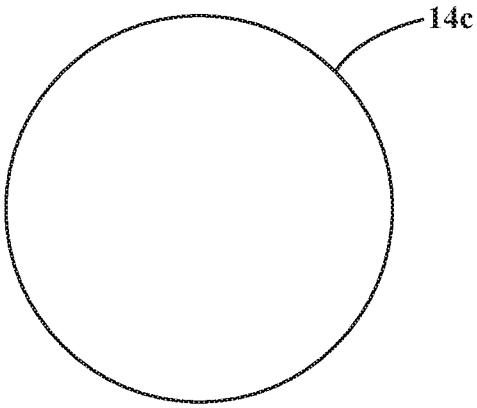
FIGS. 4-8 illustrate cross-section views of front and rear sections of the outer pontoons and the center pontoon, illustrating the increased width of the rear section relative to the front section.
Figure 5:
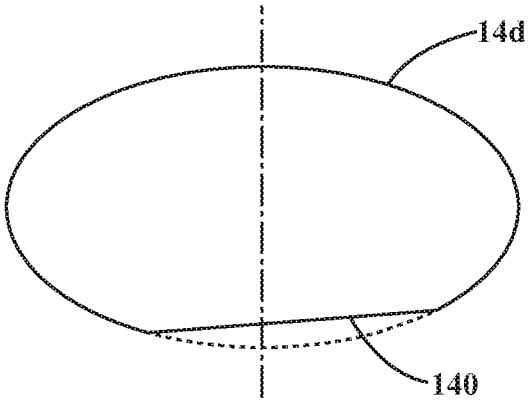
Figure 6:
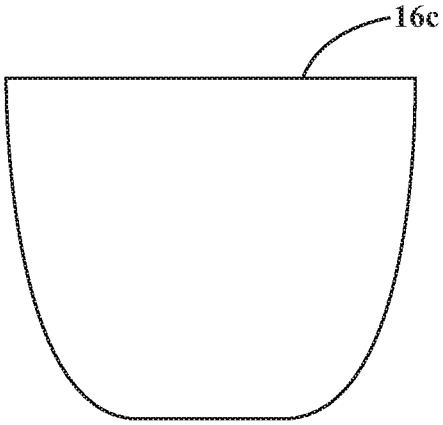
Figure 7:
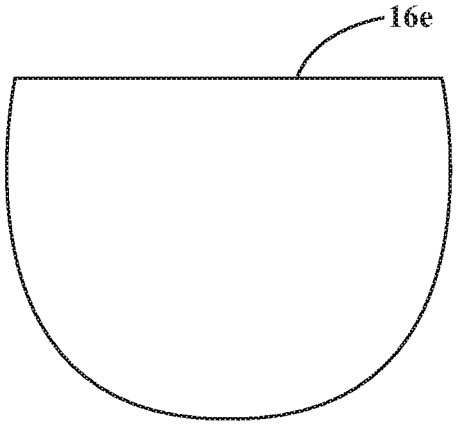
Figure 8:
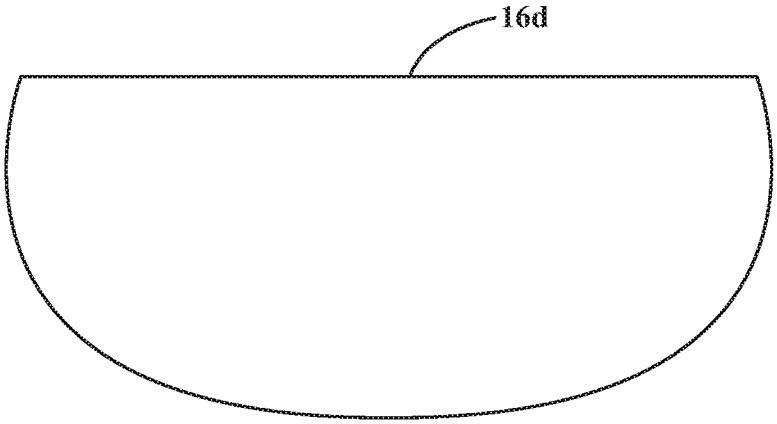

As described above and shown in FIGS. 2, 4, and 5, the outer pontoons 14 have an increasing lateral width in the rearward direction. The outer pontoons 14 may therefore include a front section 14*c* and a rear section 14*d*. The front section 14*c* may have a generally cylindrical shape with a generally circular cross-section. The rear section 14*d* may have a modified non-circular cross-section, in which the width of the rear section is greater than the height of the rear section 14*d*. The rear section 14*d* may also be considered a flattened section relative to the generally circular front section, and may be formed by beginning with a circular cross-section corresponding in size to the front section 14*c*, with the cross-section compressed vertically to reduce the height of the rear section 14*d* and increase the width.

In one approach, the rear section 14*d* may have a generally non-circular ellipse shape, with a major axis extending laterally and a minor axis extending vertically. However, it will be appreciated that other non-circular shapes with a width greater than a height can also be used.

As shown, the rear section 14*d* of the outer pontoons 14 flares laterally outward on both sides of the pontoon 14, such that the width increases toward the center pontoon 16 and the width also increases laterally outward away from the centerline of the boat 12. However, in another approach, the width of the pontoon 14 may be increased toward the center pontoon 16, and the laterally outermost surface may be generally aligned with the front section 14*c*. As shown, the rear section 14*d* flares outward on each side of the pontoon 14 at approximately the same amount. However, the rear section 14*d* may flare outward a greater amount toward the center pontoon 16 relative to the amount on the outer side of the pontoon 14.

The rear section 14*d* joins with the front section 14*c* at a transition therebetween. Accordingly, at the point of the transition, the cross-section of the rear section 14*d* is essentially the same as the cross-section of the front section 14*c*. The difference between the cross-section increases at distances further from the transition, such that the width of the rear section 14*d* is greater at the rear end of the boat 12 than at a location near the transition between the front section 14*c* and the rear section 14*d*. Put another way, the rear section 14*d* tapers out in the lateral direction and tapers down in the vertical direction.

In one approach, the transition between the rear section 14*d* and the front section 14*c* is disposed at a point more than 50% away from the front of the boat. In one approach, the transition point may be between 60-70% of the length of the boat as measured from the front of the boat 12.

With regard to the center pontoon 16, as shown in FIGS. 2 and 6-8, the center pontoon 16 may also include a front section 16*c* and a rear section 16*d*, and may further include an intermediate section 16*e* disposed longitudinally between the front section 16*c* and the rear section 16*d*. The center pontoon 16 may have a generally U-shaped cross section. The width of the cross-section of the center pontoon 16 increases in a rearward direction. The front section 16*c* may have a width that is generally constant along its length. The rear section 16*d* may have a width that increases in the rearward direction. The intermediate section 16*e* may also have a width that increases along its length.

The front section 16*c* may transition into the intermediate section 16*e*, such that the width of the center pontoon 16 will begin to increase. The intermediate section 16*e* may then transition into the rear section 16*d*, where the width may then increase further. At the rear end of the rear section 16*d*, the width of the center pontoon 16 may be such that it nearly intersects with the outer pontoons 14, which also have increased widths, as described above.

Accordingly, in view of the increasing widths of the outer pontoons 14 and center pontoon 16, the space 22 between the pontoons 14, 16 decreases in a rearward direction, due to the space being taken up from the widths that increase and encroach into the spaces 22, as shown in FIG. 2. The encroachment of the pontoons 14, 16 into the spaces 22 thereby provides a blocking structure that blocks water flowing in the spaces 22 from exiting the rear of the boat 12, thereby forcing the water further downward.

Figure 9:
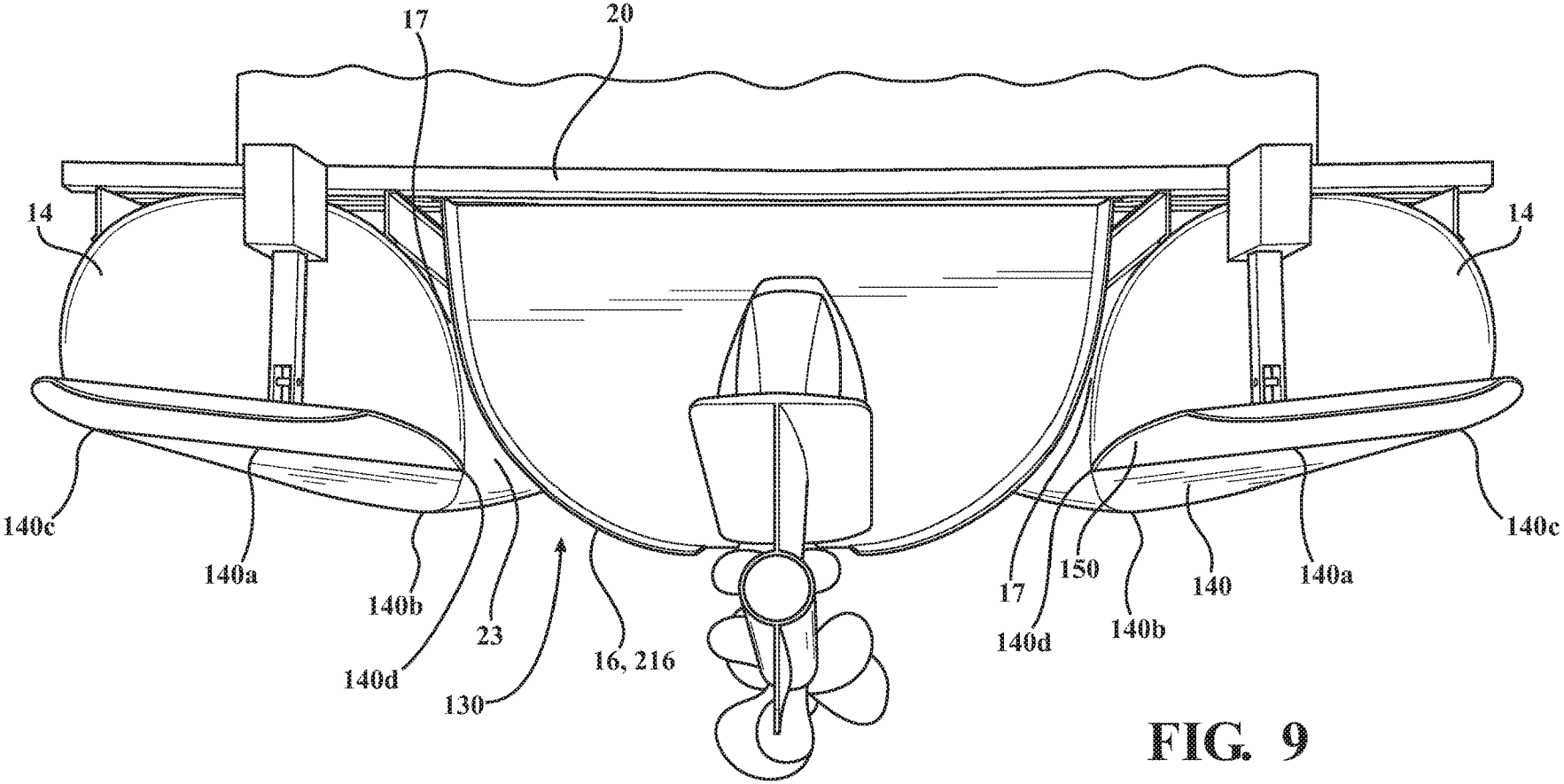
FIG. 9 illustrates a rear view of the boat.

With reference to FIG. 9, the combined widths of the outer pontoons 14 and the center pontoon 16 combine to define a segmented transom 130. The segmented transom 130 is discontinuous across the width of the boat 12, with small spaces defined laterally between the center pontoon 16 and the outer pontoons 14. However, from a water displacement standpoint, the combined transom may provide similar benefits as a continuous transom.

Additionally, the curved shape of the bottom surfaces of the outer pontoons 14 and the center pontoon 16 combines to define a track channel 23 below the intersection points 17. The combined bottom surface of the segmented transom 130 is not flat, due to the rounded bottom surfaces of the pontoons 14, 16. Accordingly, curved triangular cross-sections are defined laterally between the pontoons 14, 16 and below the intersection point 17. As described above, water travels through the spaces 22 between the pontoons 14, 16 and is displaced downward. The water will also flow through space of the track channels 23, effectively providing a track of water on which the pontoons 14, 16 are supported, providing additional control of the boat 12.

Figure 10:
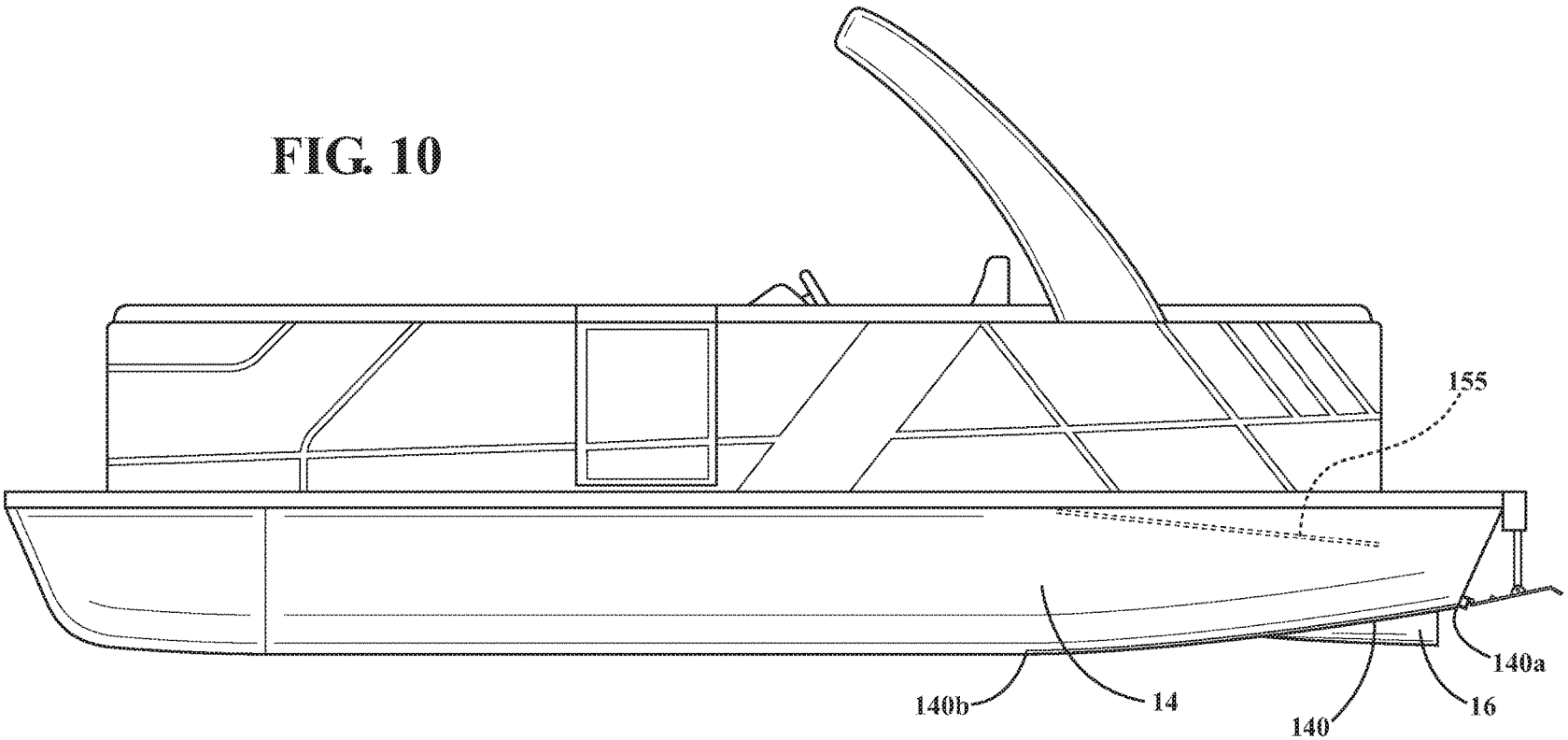
FIG. 10 illustrates a side view of the boat.
Figure 11:
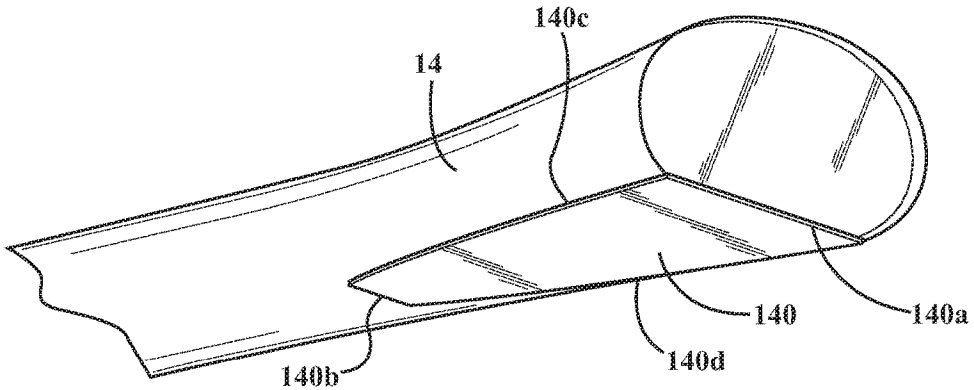
FIG. 11 illustrates the bottom inclined surface on one of the outer pontoons.

With reference to FIGS. 10 and 11, in addition to the increased width of the pontoons 14, 16, the outer pontoons 14 may further include an inclined surface portion 140 disposed on the bottom of the rear section 14*d*. The inclined surface portion 140 may be defined as a "slice" off of the cross-sectional shape of the rear section 14*d*. Put another way, the inclined surface portion 140 may be defined by a plane that intersects the cross-section of the rear section 14*d*, such that a portion of the rear section 14*d* is removed, with the inclined surface portion 140 filling in the removed section, leaving the inclined surface 140 to intersect the remaining the portion of the rear section 14*d*. The inclined surface may be curved in the longitudinal direction (as shown in FIG. 10) and, optionally, in the lateral direction, such that it forms a convex curvature facing downward. Accordingly, the inclined surface 140 may not be planar, in one aspect when it is curved, or it may be generally planar The inclined surface 140 is oriented at an incline relative to the longitudinal direction of the outer pontoon 14. The inclined surface 140 therefore has a rear edge 140*a* that is disposed above a front edge 140*b* of the inclined surface 140. Due to the inclined orientation of the inclined surface 140 relative to the rear section 14*d* of the outer pontoon 14, the width of the inclined surface 140 at its rear is greater than the width of the inclined surface 140 at its front. The inclined surface 140 therefore may have a generally trapezoidal profile, resembling for example a spatula blade. Put another way, the longitudinally forward edge 140*b* of the inclined lower portion has a first laterally extending length and the longitudinally trailing edge 140*a* has a second laterally extending length, and the second laterally extending length is greater than first laterally extending length.

As shown in FIG. 9, the inclined surface 140 may also be inclined in the lateral direction, such that a laterally outer edge 140*c* of the inclined surface 140 is above the laterally inner edge 140*d*. At the rear edge of the inclined surface 140, the angle of inclination in the lateral direction may be about 7-8 degrees.

Due to the inclined surface 140 being defined by a removed portion of the rear section 14*d*, the inclined surface 140 thereby defines the bottom rear edge of the outer pontoon 140. Accordingly, when the inclined surface 140 is inclined laterally, the bottom rear edge of the outer pontoon 14 is likewise inclined laterally.

The inclined surface 140 faces generally downward, and defines a portion of the overall bottom surface of the outer pontoon 14. Accordingly, during operation of the boat 12, water flows past the inclined surface 140 and is displaced by the inclined surface 140. When the inclined surface 140 is inclined laterally, the inclined surface 140 faces laterally outward in addition to facing downward. Thus, water being displaced by the outer pontoons 14 may be directed laterally outward in addition to being displaced laterally downward.

In the rearward direction of the boat 12, the inclined surface 140 inclines upward, as shown in FIG. 10. Accordingly, while water is displaced downward due to the placement of the pontoon 14 into the water, the water may also be directed along the upwardly inclined direction of the inclined surface 140. Accordingly, at high speeds, the water flowing along the bottom of the outer pontoons 14 may be displaced laterally outward, and drag may be reduced by allowing the water to flow along the upward inclination of the inclined surface 140. In the case of the inclined surface being inclined in the longitudinal direction but being generally flat in the lateral direction, the water flowing along the inclined will not be displaced laterally outward as much as when the inclined surface 140 is inclined laterally. However, it will be appreciated that there is still some lateral displacement that occurs.

The inclined surface 140, in one aspect, includes a downward facing convex curvature in the fore-and-aft direction. Put another way, when viewed from the side, as in FIG. 10, the inclined surface has a curved profile. Thus, the laterally outer edge 140*c* of the inclined surface 140, such as where the inclined surface 140 intersects with the curved outer surface of the pontoon 14, has a curvature that curves upward toward the rear of the pontoon 14.

The convex curvature of the inclined surface 140 need not be substantial. The curvature operates to create a "coanda effect" in which a fluid will tend to adhere to the surface against which it flows, similar to the top of an airfoil. In the case of the inclined surface 140 facing downward, the coanda effect causes the water flowing along the inclined surface 140 to track along the surface and be projected in an upward direction as it flow past the rear of the pontoon 14. The curvature of the inclined surface 140 also operates to create a downforce on the pontoon 14, which aids in displacing the water below the pontoon 14.

The inclined surface 140 may also include a downward facing convex curvature in the lateral direction. In this approach, when viewed from the rear, the edge of the inclined surface 140 may appear curved. However, in another approach, the inclined surface 140 may be generally flat in the lateral direction, such that when viewed from the rear, such as the view shown in FIG. 9, the inclined surface appears flat.

Figure 12:
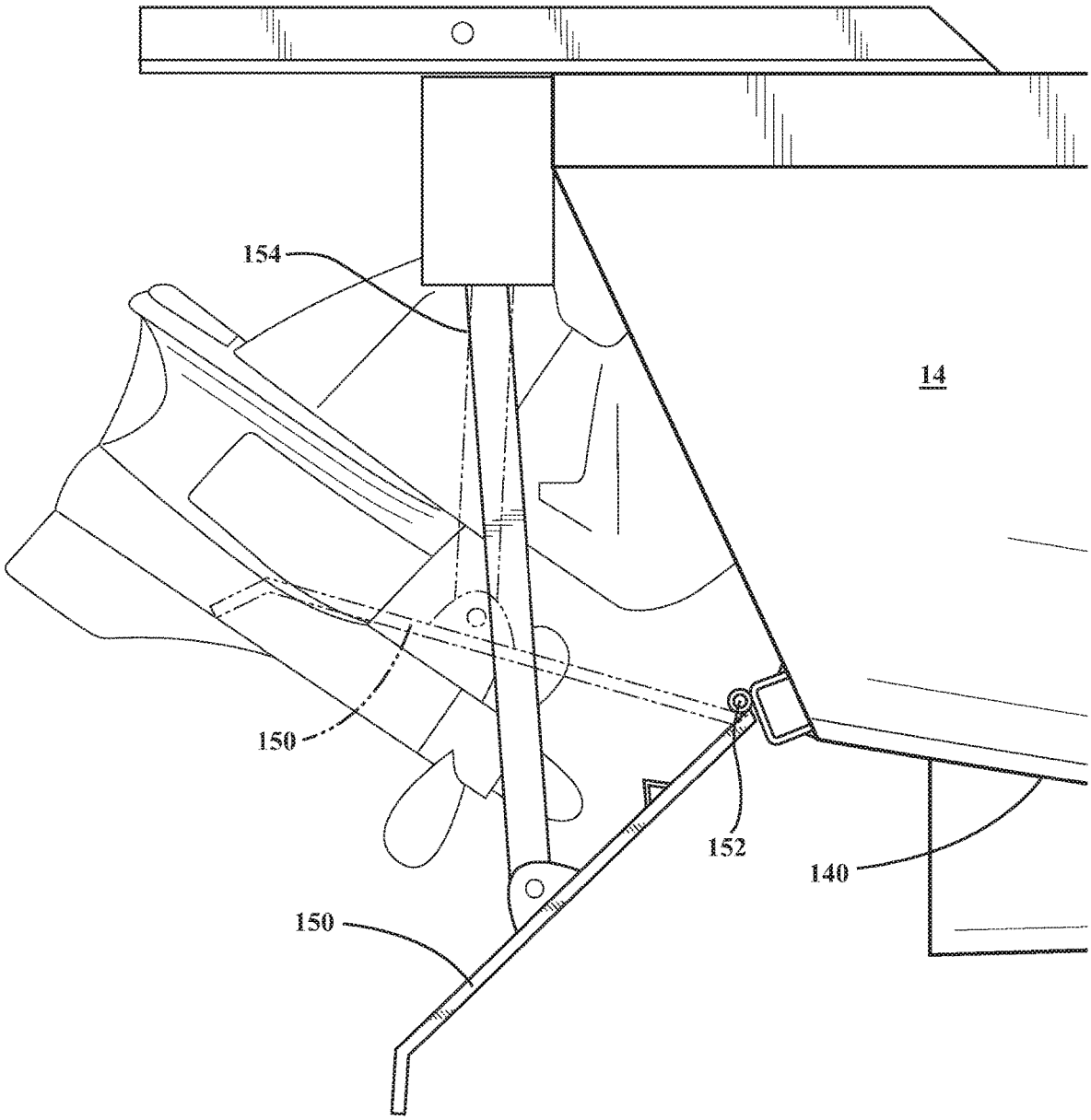
FIG. 12 illustrates a side view of the wake panels and the retracted and deployed positions thereof.
Figure 13:
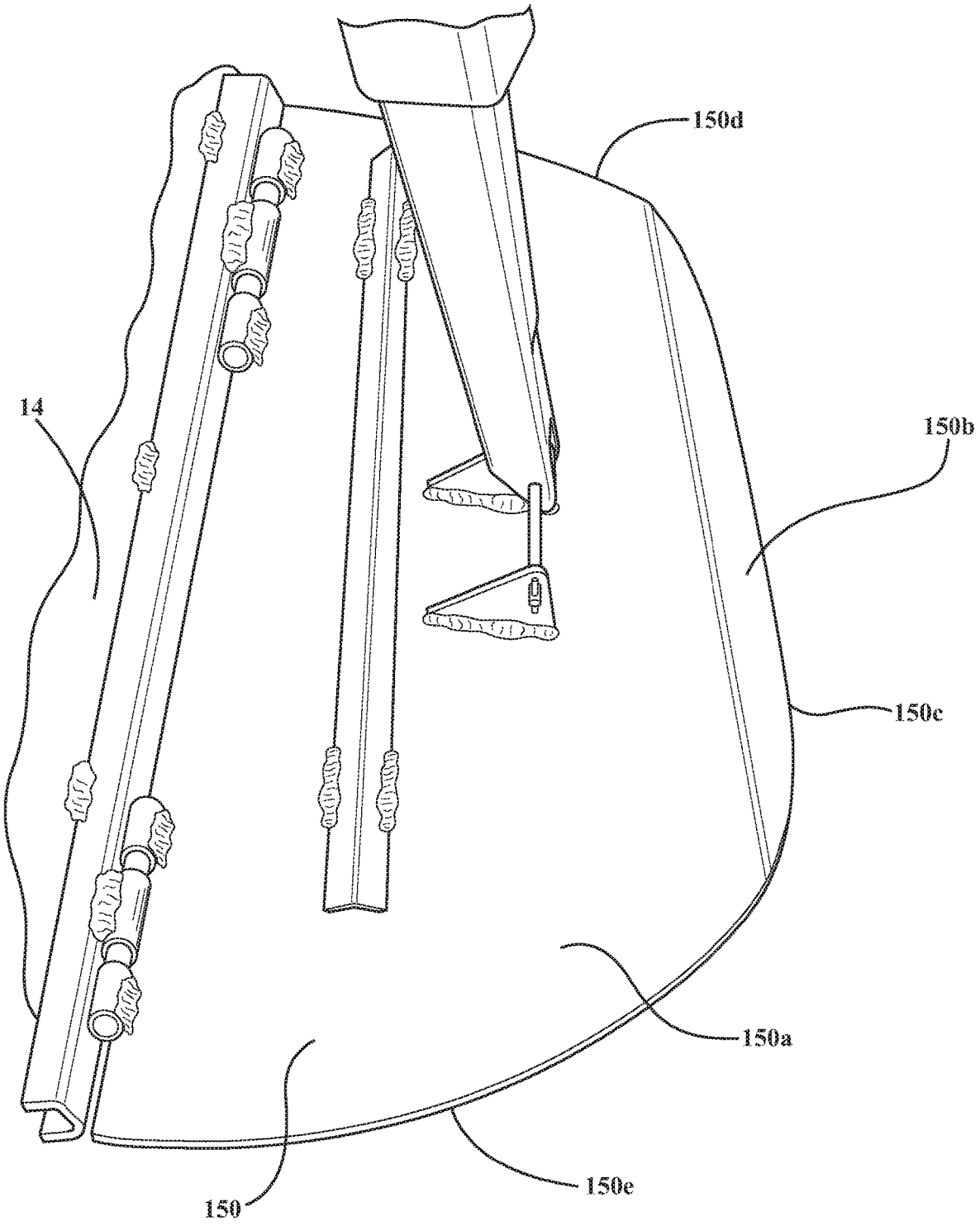
FIG. 13 illustrates a top view of a wake panel.

As shown in FIGS. 1, 12, and 13 in addition to the pontoons 14, 16, the system 10 further includes actuatable wake panels 150. The wake panels 150, similar to the outer pontoons 14, may be arranged in a pair that are generally symmetrical across the centerline of the boat. The wake panels 150 may include a first wake panel and a second wake panel, with the first wake panel 150 being coupled to the first outer pontoon 14, and the second wake panel 150 being attached to the second outer pontoon 14. For the purposes of discussion, the wake panels 150 may be discussed as a pair or individually, and it will be appreciated that reference to the structure and functionality of a single wake panel will apply to the other wake panel, unless otherwise noted. However, the wake panels 150 are independently actuatable, so it shall not be assumed that the actuated position of a single wake panel necessarily implies the same actuation of the other wake panel.

The wake panels 150 are coupled to the rear ends of the outer pontoons 14. The wake panels 150 may be attached to the outer pontoons 150 via a pivotable hinge structure 152, allowing the wake panels 150 to pivot upward and downward relative to the fixed shape of the outer pontoons 14. The pivot axis of the hinge structure 152 is preferably aligned with the rear edge defined by the inclined surface 140. Accordingly, when the inclined surface 140 is inclined laterally, the pivot axis of the hinge structure 152 is also inclined laterally.

The wake panels 150 essentially extend rearward from the rear edge of the inclined surface 140 and the outer pontoon 14. The wake panels 150 may have various positions depending on the degree to which they are actuated relative to the outer pontoons 14. In one approach, the wake panels 150 may have a retracted position, where the wake panel 150 is oriented at an angle that is approximately the same as the angle of inclination of the inclined surface 140, as shown in phantom line in FIG. 12. Accordingly, the wake panels 150 may operate as an extension of the surface of the inclined surface 140. The wake panels 150 may further include a deployed position, as shown in solid line in FIG. 12, in which the wake panels 150 are inclined downward relative to the inclined surface 140, such that the wake panels 150 would project downwardly into the water, increasing an amount of downward displacement of water that impacts the wake panels 150 in the deployed position. It will be appreciated that the downward angle of inclination shown in FIG. 12 is exemplary, and that the angle of inclination may be varied to suit the needs of the user and to tailor the resulting wake profile of the user. Regardless, in the deployed position, the wake panels 150 are deployed down and into contact with the water to produce a desired wake profile.

The wake panels 150 may be actuated by an actuator mechanism 154, which may be a linear actuator. The actuator mechanism 154 may be attached to a middle portion of the upper surface of the wake panel 150, such that extension of the actuator mechanism 154 will force the wake panel 150 downward, and retraction of the actuator mechanism 154 will retract the wake panel 150 upward. The actuator mechanism 154 may also be in the form of a linkage that may move between two predetermined positions, namely the retracted position and the deployed position, with a supplemental actuator mechanism that moves the linkages of the linkage mechanism relative to each other. In the case of a linear actuator, the actuator mechanism 154 may be sized and configured to resist loads exerted on the wake panel 150, in particular when the wake panels 150 are in the deployed position and water is impacting the wake panels 150. In the case of a linkage mechanism, the linkages may resist the majority of the loading on the linkage mechanism, with the supplemental actuator receiving reduced loads.

With reference to FIGS. 12 and 13, the wake panels 150 may have a generally planar shape, and may include a front portion 150*a* and a rear portion 150*b*. The front portion 150*a* may be planar, and the rear portion 150*b* may be planar, with the rear portion 150*b* inclined downward relative to the front portion 150*a*. The rear portion 150*b* may be substantially smaller relative to the front portion 150*a*, such that the length of the front portion 150*a* is greater than the length of the rear portion 150*b*. The wake panels 150 may further include a trailing edge 150*c*. The edge of the wake panel 150 may be curved along both the front portion 150*a* and the rear portion 150*b*.

The wake panels 150 may include a laterally outer edge 150*e* (or outboard lateral edge) and a laterally inner edge 150*d* (or inboard lateral edge). The trailing edge 150*c* is longitudinally spaced from the hinge axis of the wake panel 150. In one aspect, outboard edge 150*e* is relatively longer than the inboard edge 150*d*.

With the outer edge 150*e* being longer than the inner edge 150*d*, the trailing edge 150*c* may therefore be angled relative to the leading edge and/or hinge axis of the wake panel 150. The angle of the trailing edges 150*c* of each wake panel 150 are each directed forward and toward the center of the boat, such that they may be considered opposite each other or mirrors of each other relative to the center of the boat 12.

The downwardly bent rear portion 150*b* of the wake panel 150 may be generally planar, similar to the major front portion 150*a*. The bent portion 150*b* is adjacent the trailing edge 150*c*.

As shown, the curvature of the outer edge 150*e* transitions into trailing edge 150*c*. The curvature of the outer edge 150*e* extends along both the front portion 150*a* and the bent rear portion 150*b*. The outer edge 150*e* may be curved along a substantial portion of its length.

The inner edge 150*d* may also be curved along at least a portion of its length. The inner edge 150*d* may be curved along a portion of its length that is less than that of the outer edge 150*e*.

The curved portions of the outer edge 150*e* and inner edge 150*d* operates to reduce drag and also assists in shaping the wake profile. The water being displaced by the wake panel 150 when it is deployed is allowed to curl back around the edges of the wake panel 150.

As described above, the wake panels 150 are actuatable between a retracted position, in which the wake panels 150 are raised, and a deployed position, in which the wake panels 150 are disposed downward into the water and at an inclination relative to the inclined surface 140 of the outer pontoons 14. When the boat 12 is desired to travel at high speeds, the wake panels 150 are preferably arranged in the retracted position to reduce drag. When the boat 12 is desired to travel at a slower speed and to produce a wake profile for wake boarding or the like, the wake panels 150 may be positioned in the deployed position. With the wake panels 150 disposed in the deployed position, the water impacting the wake panels 150 will be displaced downward by the wake panels 150, forcing the water downward. In response, the water will flow back upward after passing beyond the wake panels 150, and the upward flow of the water after being displaced downward by the wake panels 150 will produce an improved wake profile that is surfable by a wake boarder or the like.

In one approach, the wake panels 150 may be actuated separately, such that the first wake panel 150 may be in the deployed position and the second wake panel 150 may be in the retracted position. In this arrangement, the wake profile may be increased at the side of the first wake panel, while the wake profile at the side of the second wake panel is smaller. Similarly, the second wake panel 150 may be disposed in the deployed position, and the first wake panel 150 may be disposed in the retracted position, resulting in wake profile that is higher on the side of the second wake panel 150.

The wake panels 150 may also be independently actuatable at different degrees, such that one or both of the wake panels 150 may be disposed at an intermediate position between the previously described retracted position and deployed position, depending on the degree of actuation of the actuation mechanism 154. Similarly, the wake panels 150 may be retracted further than the previously described retracted position, in which the wake panels 150 are oriented upward relative to the inclined surface 140.

Thus, in view of the above, the wake panels 150 may be controlled and actuated to the desirable position depending on the desired use of the boat 12. The boat 12 may therefore be operated in wake-profile producing mode when one or more wake panels 150 are deployed, or may be operated in a traditional non-wake-profile producing mode, in which the boat 12 may be operated at high speeds with reduced wake.

The combination of the limited spacing between the pontoons 14, 16 and the wake panels 150 therefore combine to displace additional water downward relative to a traditional pontoon boat 12, such that the boat 12 may also be used as a wake boat. As described above, the water traveling between the pontoons 14, 16 is substantially blocked from exiting the rear of the boat 12, and therefore is displaced downward, which results in an increased wake profile. However, as described previously, some water traveling between the pontoons 14, 16 may tend to be urged upward and over the intersection point 17 between the pontoons 14, 16. This water may tend to exit the space 22 between the pontoons 14, 16, thereby reducing the amount of water that is displaced downward.

With reference to FIGS. 2 and 10, to counteract the water that may exit above the intersection point, the system 10 may further include splash panels 155 disposed between the pontoons 14, 16. The splash panels 155 may operate to block the water that would otherwise exit above the intersection point 17. The splash panels 155 may also be referred to as deflector plates.

The splash panels 155 may have a generally triangular shape, and may be generally planar. The shape of the splash panels 155 preferably corresponds to the shape of the space between the pontoons 14, 16 in the area just forward of the intersection point. Accordingly, the outward flared shape of the outer pontoons 14 and the center pontoon 16 at the rear of the boat results in the shape of the space having a generally triangular shape, as shown in FIG. 1, and the shape of the splash panels 155 can thereby be triangular.

The splash panels 155 may be symmetrically arranged relative to the centerline of the boat 12 when the pontoons 14, 16 are also symmetrically arranged. In an approach where the pontoons 14 are not symmetrically shaped, the splash panels 155 may have a non-symmetrical shape, corresponding to the shape of the space defined between the pontoons 14, 16. For the purposes of discussion, the symmetrical arrangement will be described.

As shown in FIG. 10, the splash panels 155 may be arranged at an inclination relative to the platform 20 of the boat 12. The splash panels 155 may be arranged such that the splash panels 160 are inclined downward in a rearward direction. Put another way, a rear end of the splash panel is disposed below a front end of the splash panel 155.

The front end of the splash panel 155 is wider than the rear end of the splash panel 160. In one approach, the rear end of the splash panel may be in the form of a point or other convergence. The lateral sides of the splash panel 155 are closer together at the rear relative to the front. The splash panel 155 has a tapered shape that tapers down in the rearward direction.

The splash panel 155 is disposed above the intersection point 17 between the pontoons 14, 16, and is not intended to be submerged below the surface of the water in normal operating conditions. Rather, water that is being channeled through the space 22 between the pontoons 14, 16 may be displaced upward or splashed upward during operation. This water may therefore come into contact with the splash panel 160, which will divert the water downward and below the intersection point.

The splash panels 155 are preferably fixed in place relative to the pontoons 14, 16 and the platform 20. Put another way, the splash panels 155 are not actuated between different positions. Because the splash panels 155 are not disposed below the surface of the water, there is no need to retract the splash panels 155 toward the platform 20 or away from the water during different operating conditions. Rather, the splash panels 155 may remain in the same position during a wake-producing condition or a high speed condition.

Figure 14:
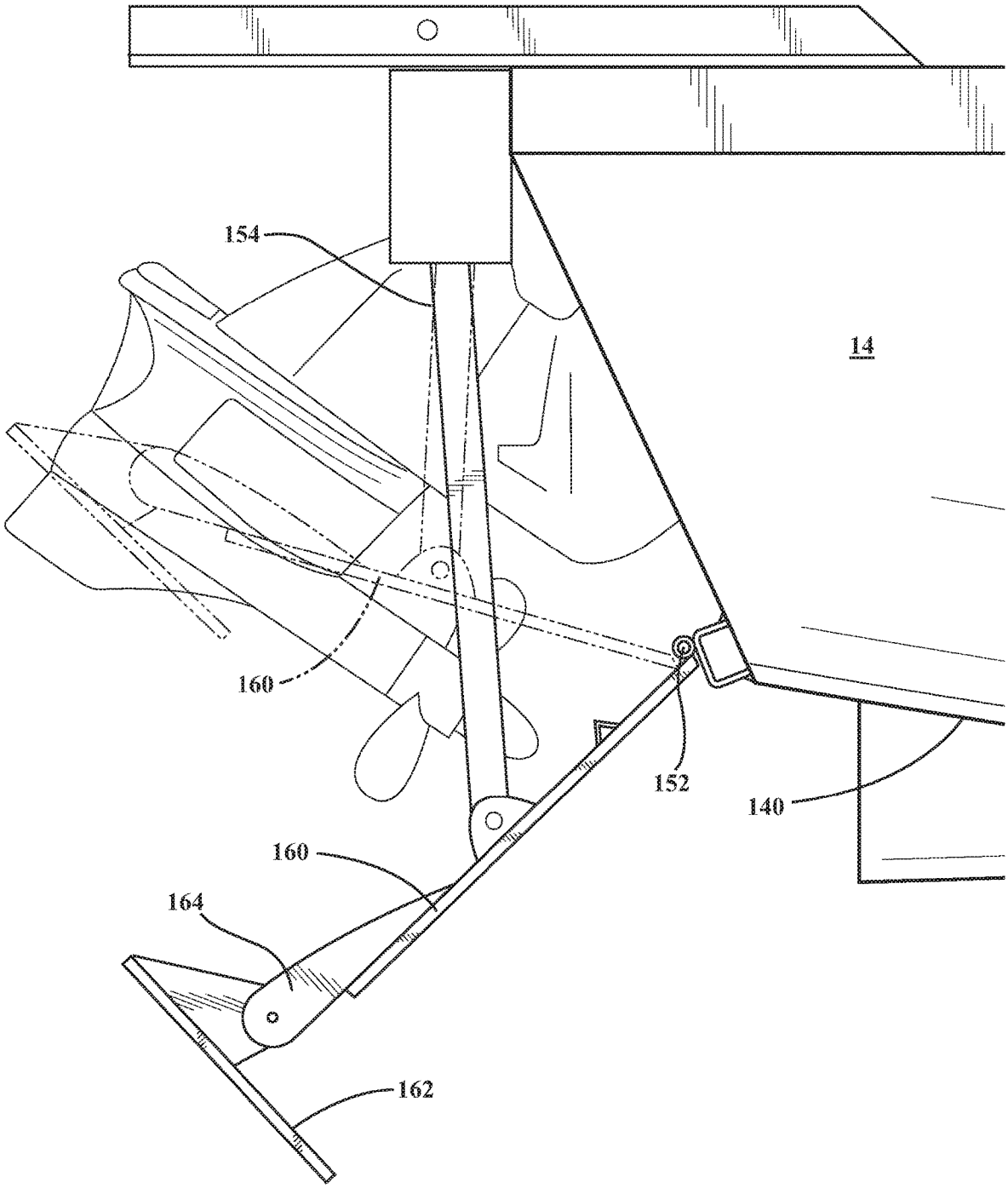
FIG. 14 illustrates a side view of another wake panel having an inclined foil member spaced away from a trailing edge of the wake panel.
Figure 15:
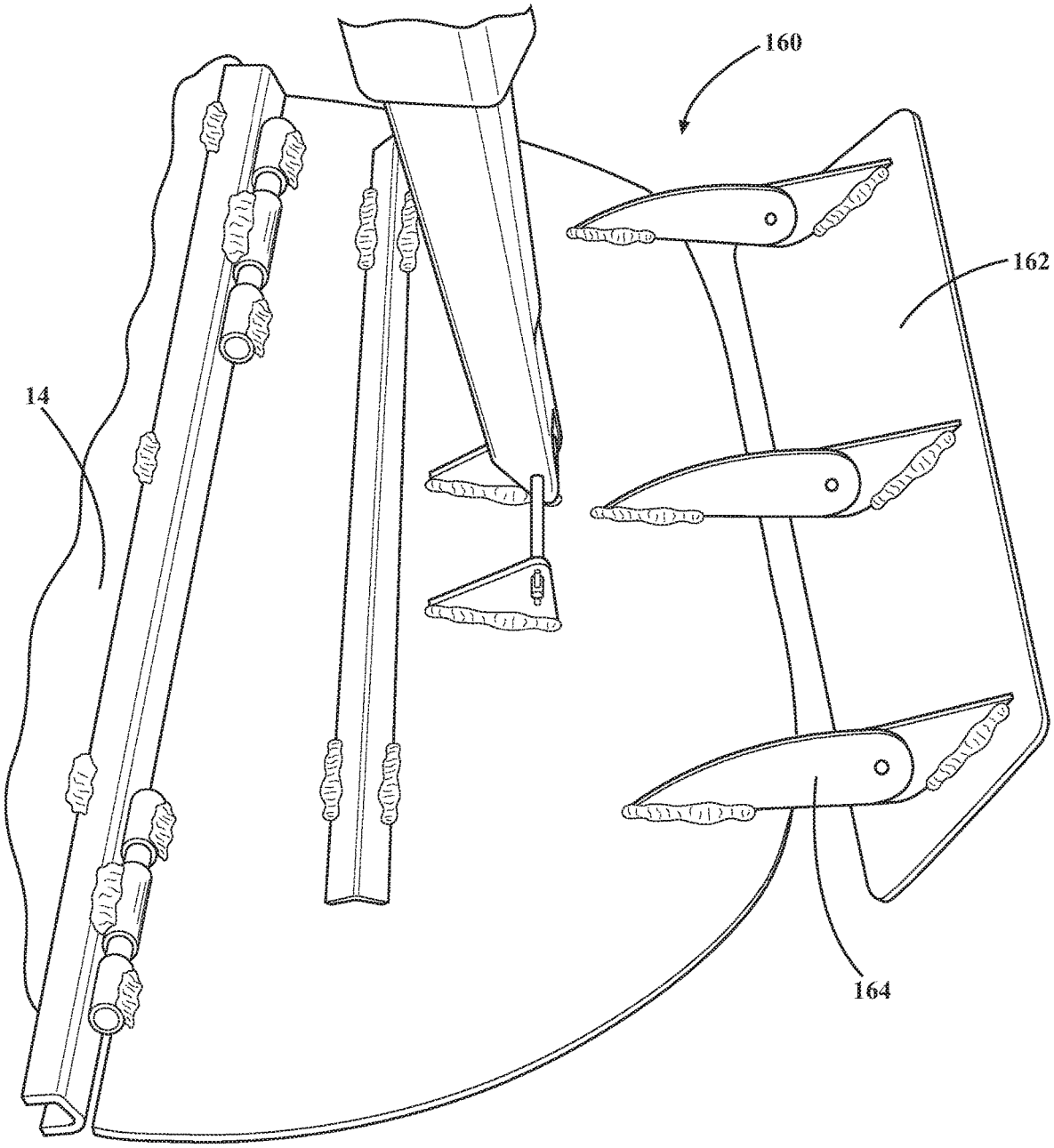
FIG. 15 illustrates a top view of the wake panel of FIG. 14.

With reference now to FIGS. 14 and 15, in another aspect, an alternative wake panel 160 may be used. The wake panel 160 is attached and operated similarly to the wake panel 150, and may be applicable to each of the Figures illustrating wake panel 150. The wake panel 160 differs from the wake panel 150 in that it is generally flat and does not include a bent trailing portion. Instead, the wake panel 160 may include a trailing inclined foil member 162. The foil member 162 extends downward and forward, such that water flowing past the wake panel 160 will impact the leading face of the foil member 162 and be directed upward. Accordingly, the foil member 162 will provide additional downforce, while also operating to shape the wake by directing the water upward along the inclined surface of the foil member 162.

The foil member 162 is spaced away from the trailing edge of the wake panel 160, allowing water to flow over the forward face of the foil member between the trailing edge of the wake panel 160 and the leading edge of the foil member 162. While the foil member 162 is spaced away from the wake panel 160, the foil member 162 may be attached to the wake panel by a plurality of laterally spaced gussets 164. The gussets 164 may be oriented such that water flowing past them will not be substantially affected. Put another way, the flat shaped body of the gussets 164 may extend generally perpendicular from the surfaces of the wake panel 160 and the foil member 162.

The gussets 164 may be in the form of a single fixed piece, or they may be in a two-piece arrangement with a hinge or pivot mechanism disposed in the middle, allowing the angle of the foil member 164 to be adjustable relative to the wake panel 160. Thus, the angle of the foil member 162 may be set to an angle/orientation to specifically tailor the shape of the wake that is produced to accommodate different users or different desired wake types.

The shapes of the pontoons 14, 16 were described above. It will be appreciated that variations in the shape of the pontoon 14, 16 may be possible without substantially affecting the functionality described above. The pontoons 14, 16 may be generally hollow, thereby providing buoyancy when disposed in the water and allowing the boat 12 to float. The pontoons 14, 16 may have additional shape characteristics, such as the leading edge of the pontoon may be tapered to decrease resistance when the boat 12 is being propelled through the water. The pontoons 14, 16 may further include additional rail structure or splash guards that are typically used with traditional pontoon boats.

Traditional pontoon boats are designed to produce reduced resistance in the water such that the pontoons 14, 16 will float high on the surface of the water, thereby displacing a smaller or minimal amount of water. As passengers are added to the pontoon boat, the weight thereby increases, displacing an additional amount of water. Increasing the water displacement will increase the wake produced by the pontoon boat. However, the wake produced by a traditional pontoon boat is typically very unorganized and turbulent around the pontoons. During operation of the traditional pontoon boat, a non-organized wake is produced within the channel between the pontoons as well as behind the pontoons. Typically, it is desirable to reduce water displacement, drag, and wake produced by a pontoon boat, such that the boat may be more energy efficient and require less power to propel the boat through the water. In the present improved system 10, wake and drag may be desirable in select operating conditions, and the system 10 will therefore produce an increased amount of water displacement, wake, and drag, which is the opposite of a traditional pontoon boat. However, the system 10 also allows for the boat 12 to produce reduced displacement and drag when the wake panels 150 are in the retracted position, similar to a traditional pontoon boat.

In the present improved system 10, the system 10 operates to control and organize the wake produced by the pontoon boat 12, and in particular the wake produced between the pontoons 18.

In the retracted position of the wake panels 150, the boat 12 may operate in a manner resembling a traditional pontoon boat. In the deployed position, the wake panels 150 will make contact with the water, thereby displacing and directing an additional volume of water relative to a traditional pontoon boat that is not otherwise displaced.

For the purposes of the discussion, the deployed position will be understood to mean the desired, optimum, or target position for enhancing the wake profile characteristic. It will be understood that other positions relative to the second position, including intermediate positions or positions further downward from the second position, may also be used that enhance the wake pattern relative to the retracted position.

When the wake panel 150 is in the deployed position, the wake panel 150 will extend downward into the water and will direct the previously unorganized and turbulent water flow behind the pontoons 14 in a controlled manner, organizing the water flow and directing it downward and rearward along the wake panel 150, where the flow may then pass beyond the rear end of the wake panel 150 and return upward to produce the increased wake profile. Thus, the wake panels 150 operate to displace an additional amount of water relative to a traditional pontoon boat, which creates additional drag on the boat 12.

By disposing the wake panels 150 into the water, and displacing and directing more water, the wake panels 150 thereby create additional surface area that contacts the water, similar to other boat types that displace water over a greater surface area than a traditional pontoon boat. The increase of surface area is desirable for creating an enhanced wake pattern behind the boat 12. As described previously, the wake panels 150 may be individually controlled and actuated, meaning that the wake panels 150 may be at different angles relative to each other for producing the desired wake characteristic. In addition to wake panels 150, there are other manners of increasing the surface area in contact with the water to provide an enhanced wake pattern. For example, ballast may be added to the boat 12 in different ways, thereby increasing the weight of the boat 12 and increasing the amount that the pontoons 14, 16 extend into the water.

When extended downward, the wake panels 150 contact the water and force the water downward in accordance with the angle of the wake panels 150. However, the water also provides an upward reaction force on the wake panels 150. Accordingly, in order to increase the amount of water displacement caused by the wake panels 150, it may be desirable to provide additional downward force on the boat 12. The additional downforce on the boat 12 may be provided by ballast, in one approach. The downforce contributes to the displacement of the water and counteracts the reaction force of the water that tends to urge the boat upward out of the water.

As previously mentioned, the system 10 may include ballast mechanisms 50 disposed at various locations of the boat 12 to selectively increase the weight at specific locations of the boat 12 in order to increase water displacement, as desired. Ballast may be in the form of soft bags or hard tanks that may be filled with ballast material as desired. The ballast mechanism 50 may be disposed internally within the pontoons 14, 16, with an access panel or the like provided in the top of the pontoon 14, 16 to add or remove ballast material from the ballast mechanism 50. Alternatively, the ballast mechanism 50 may be disposed at an external location relative to the pontoon 14, 16. For example, the ballast mechanism may be disposed on an inboard or outboard surface of the pontoon 14, 16, preferably at a location above the expected water level to prevent undesirable drag. The ballast mechanism 50 may be disposed below the platform 20, or the ballast mechanism 50 may be disposed above the platform 20.

The ballast mechanism 50 may be disposed at different locations on the boat 12. For example, the ballast mechanism 50 may be disposed at both rear and middle locations of the boat 12 and on both lateral sides of the boat 12. Typically, the ballast mechanism 50 may not be disposed near the front of the boat 12.

The degree or amount of ballast material used in the ballast mechanism 50, and at which location on the boat 12, may depend on the particular boat size and expected use conditions. Accordingly, the ballast mechanisms 50 may be used to specifically tailor the boat 12 for ideal usage conditions depending on the needs of the user. In one case, it may be desirable for no ballast to be used, while in another, it may be desirable for ballast to be used at both front and rear locations and on both sides. In another case, ballast may only be desirable on one side of the boat 12. It will be appreciated that various combinations of amount and location of ballast may be used. The location and amount of ballast may depend on the number of expected passengers, or the side of the wake profile where the wake surfer or wake boarder prefers to perform. The use of the ballast 50 may in some cases be sufficient to provide the necessary downforce to counteract the upward reaction on the wake panels 150.

Many of the above-described components of the system 10 include the ability to be actuated by an associated actuation mechanism. The system 10 may include a controller 60 (FIGS. 1A and 2A) including a computing device and associated hardware and software for controlling the above-described actuatable components. The controller 60 may be disposed on the boat 12 where access by the operator during operation of the boat 12 is possible, such as near the traditional boat controls or integrated into the boat control system. The controller 60 may communicate with the actuators to position the components in a desired position, and may receive feedback from the components or the associated actuators to control the position of the components.

The boat 12 may include at least two operating conditions that may be controlled by the controller 60. In the high speed operating condition, the controller 60 may prevent actuation of the wake panels 150 into the deployed position, or the controller 60 may retracted the wake panels 150 from the deployed position. When the wake panels 150 are deployed, the controller 60 may prevent the boat from traveling above a predetermined speed. Alternatively, when the boat reaches a predetermined speed, the controller 60 may automatically retract the wake panels 150 from their deployed position. The controller 60 may be configured to store different operating conditions for different users, such as a desired angle of inclination of the wake panels 150 to produce the desired wake profile. The controller 60 may also be configured to detect the amount of weight on the boat and the amount of displacement due to the weight on the boat 12, and the controller 60 may control the amount that the wake panels 150 are actuated when in the deployed position. it will be appreciated that various other control aspects may be utilized by the controller 60.

The motor and propeller used for propelling the boat 12 may be a traditional motor and propeller commonly used for pontoon boats 12 or other boat types, such as inboard drives or outboard drives with a rear mounted propeller, or an inboard/outboard (stern) drive may be used. The propeller on an outboard or inboard/outboard drive may be pivoted up out of the water when not in use.

In one aspect, shown in FIGS. 2 and 12, an inboard/outboard drive 70 may be used with a front mounted propeller. In this approach, the front-mounted propeller when in use may be disposed below the water level and directed in a forward and downward direction. Thus, the propeller itself may provide a substantial degree of downforce at the rear of the boat 12.

The above described system 10 has been described in reference to a pontoon boat 12 having outer pontoons 14 and the center pontoon 16. In another approach, the center pontoon 16 may be excluded, with the outer pontoons 14 operating to the support the platform 20. In this approach, a flow diverter 216 may be used in place of the center pontoon 16 to take up a similar degree of lateral space at the rear of the boat 12 and that may operate to block the water and force the water downward along with the outer pontoons 14, as described above.

The above-described system 10 has been described as including the wake panels 150 for producing an enhanced wake profile. However, the system 10 may also be provided without the wake panels 150, and the inclined surface 140 and flared pontoons 14, 16 may still combine to provide an improved wake profile relative to a traditional pontoon boat. The inclined surface 140 provides for improved water displacement, whether or not the surface is inclined laterally in additional to being inclined longitudinally. The downward displacement of water at the rear of the boat 12, even without the wake panels 150 actuated or provided, may still provide an improved wake profile at low speeds due to the additional downward displacement of water relative to traditional pontoon boats.

In another aspect, the system 10 may include an alternative wake panel arrangement, shown in FIGS. 16-20. The boat 12 may include the same variety of features of aspects described above, other than the wake panels 150. For example, the pontoons 14, 16 and inclined surface 140 formed on the pontoons 14, 16 may be used. The forward drive 70 may also be used. The ballast 50 and control system 60 may be used. It will be appreciated that other aspects that do not conflict with the alternative wake panel arrangement shown in FIGS. 16-20 may be used, even if not specifically mentioned.

Figure 16:
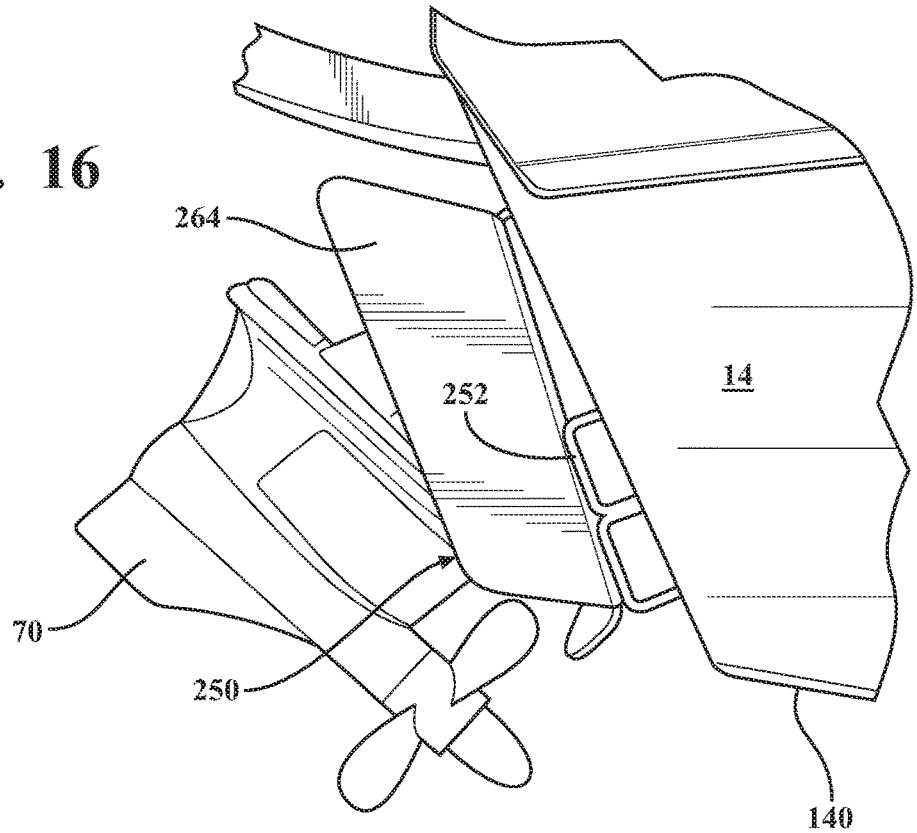
FIG. 16 illustrates a side view of another wake panel supported by the pontoon at the rear end of the pontoon shown in a retracted position.
Figure 17:
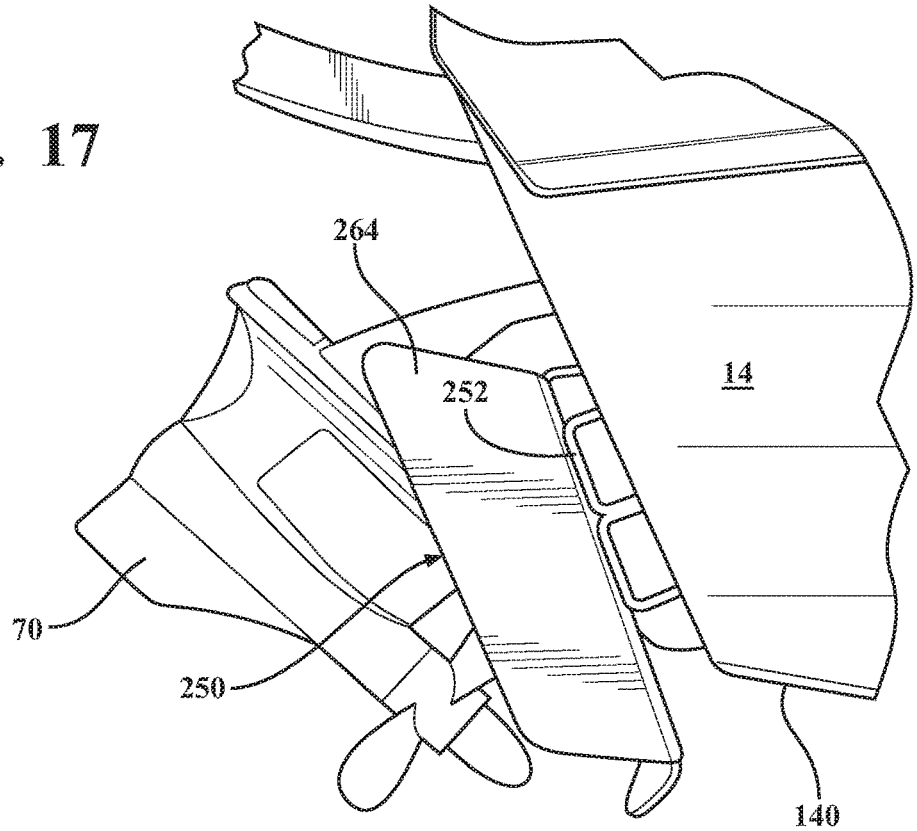
FIG. 17 illustrates the wake panel of FIG. 16 in a downwardly deployed position.
Figure 18:
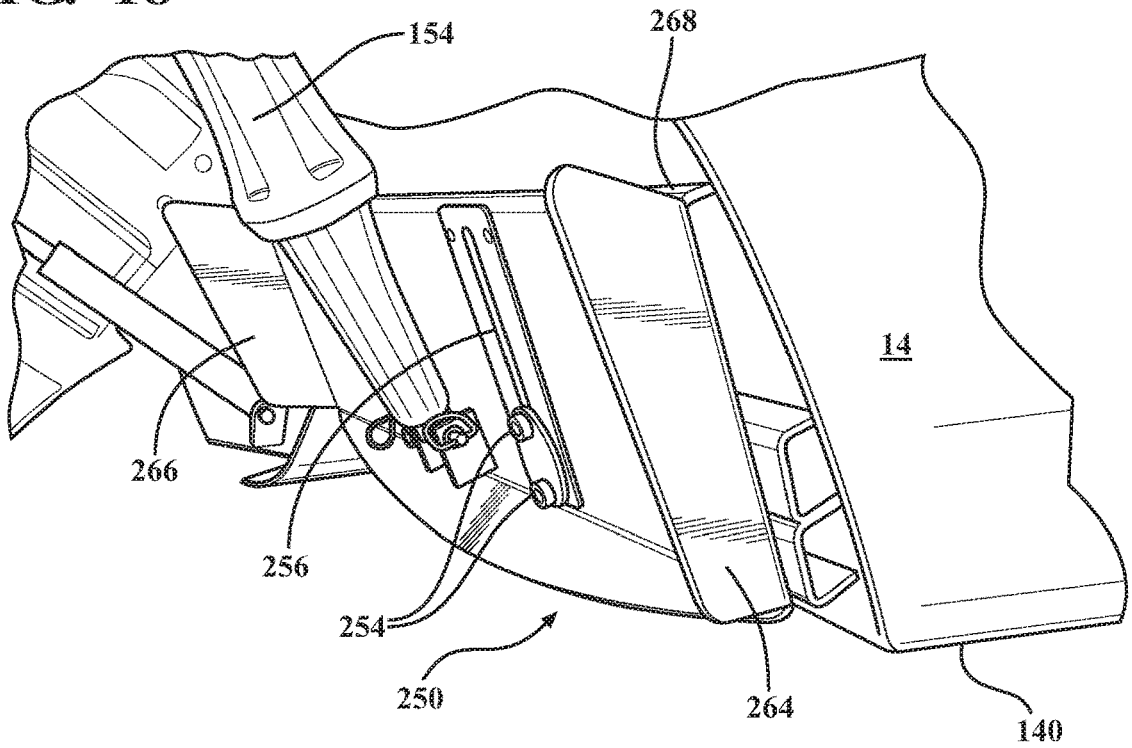
FIG. 18 illustrates a rear perspective view of the wake panel of FIG. 16 in a retracted position.
Figure 19:
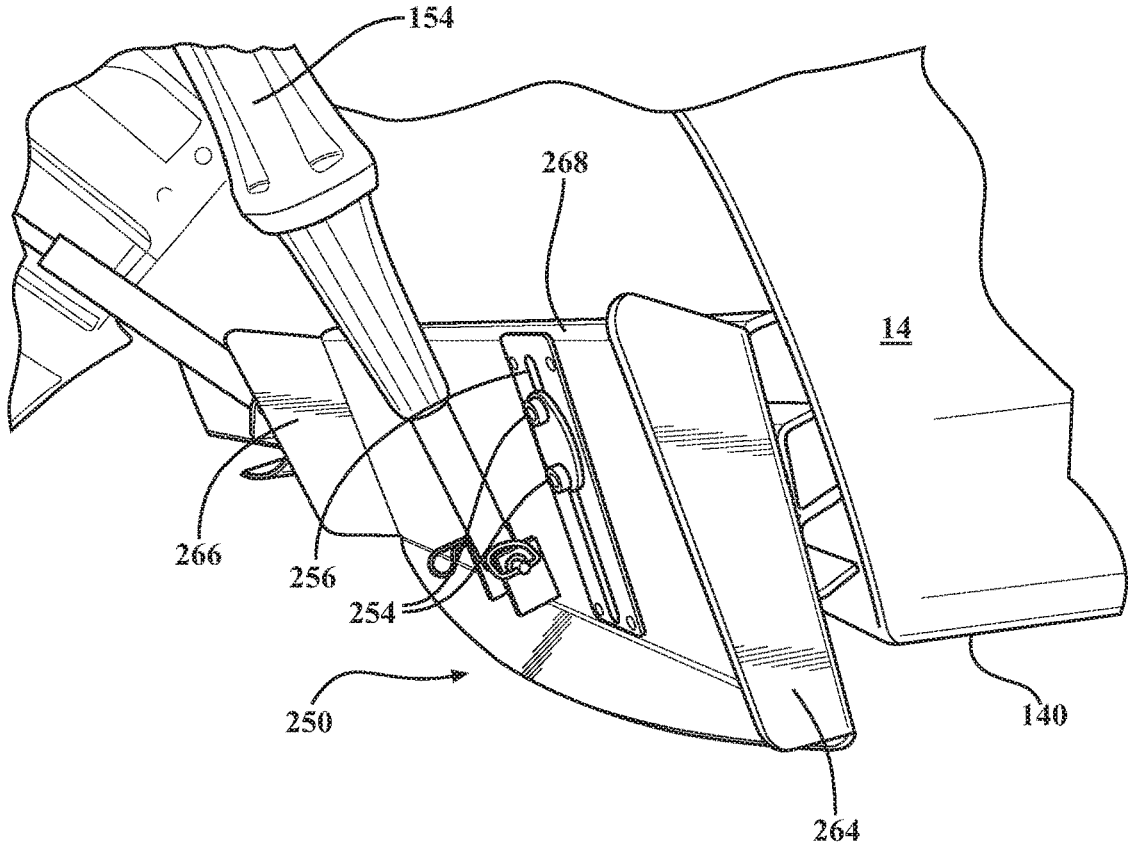
FIG. 19 illustrates the wake panel of FIG. 18 in a deployed position.

The alternative wake panel arrangement includes a deployable wake panel 250 that is arranged for sliding translational movement relative to the pontoons 14, 16. In one aspect, each pontoon 14, 16 includes an associated wake panel 250. Wake panel 250 is shown in FIG. 16 on the starboard side of the pontoon boat 12 and associated with the starboard pontoon 14. Unless otherwise noted, the wake panel 250 on the port side is symmetrical to the wake panel 250 on the starboard side. For discussion purposes, the illustrated starboard wake panel 250 will be referenced.

As shown in the side view of FIG. 16, the wake panel 250 is generally arranged at an incline relative to the longitudinal direction or travel direction of the boat 12 (for example the horizontal plane defined generally by the deck that is supported by the pontoons 14). In one aspect, as shown from the side, the panel 250 extends at an acute angle (in the upward direction) relative to a vertical plane extending vertically from the bottom edge of the panel 250. A lowermost edge of the wake panel 250 is disposed forward relative to an uppermost edge. The rear end of the pontoon 14 may extend at a similar angle (upper edge of pontoon 14 being behind the lower edge of the pontoon 14 at its rear facing surface), such that the wake panel 250 and the rear surface face of the pontoon 14 are generally parallel, with being inclined. In this arrangement, the wake panel 250 may be inclined at approximately a 22 degree forward angle relative to vertical. Put another way, in the side view of FIG. 16, the extends downward and forward from the upper end of the panel 250, and extends upward and rearward from the lower end of the panel 250.

The wake panel 250 therefore has an alignment plane disposed at a downward and forward angle. The wake panel 250 is configured to travel along the alignment plane. In one aspect, the wake panel 250 is arranged to slide along the alignment plane. Accordingly, the wake panel 250 may move or translate along the alignment plane from a stowed and/or retracted position to a deployed and/or extended. The wake panel 250 may be arranged for reciprocal movement along the alignment plane. For purposes of discussion, the wake panel 250 may be described as translating or sliding.

The wake panel 250 is supported off the stern end of one of the pontoons 14, 16. In one aspect, one or mounting rails 252 is fixed to the stern end of the pontoon 14, via welding or the like, such that the mounting rails project outwardly from the surface of the stern end of the pontoon 14 normal to the surface of the stern end of the pontoon 14. Thus, the mounting rails 252 may create a surface that is generally parallel to the surface of the stern end of the pontoon 14, and the wake panel 250 may slide along the surface defined by the mounting rails 250.

When the wake panel 250 is in the stowed position, the wake panel 250 is out of or substantially out of the water when the boat 12 is traveling along the water. In some cases, even in the stowed position, the wake panel 250 may be in contact with the surface of the water a nominal amount, depending on the overall weight of the boat 12, traveling speed of the boat 12, and the like. In one aspect, in the stowed position, the lowermost edge of the wake panel 250 is disposed below the lowermost edge of the stern end of the pontoon 14. In another aspect, the lowermost edge of the wake panel 250 may be disposed above the lowermost edge of the stern end of the pontoon 14. It will be appreciated that these relative positions are measured with the longitudinal axis of the pontoon extending in the direction of travel and being arranged generally horizontal.

In the deployed position, which is a downwardly deployed position relative to the stowed position, the wake panel 250 is substantially disposed below the surface of the water when the boat 12 is being propelled. Put another way, a lower portion of the wake panel 250 is engaged with the water while the boat is being propelled. When in the deployed position, the wake panel 250 will substantially alter the size and/or shape of the trailing wakes.

When deployed, the wake panel 250 maintains its orientation along its alignment plane, such that the lower portion is disposed forward relative to the upper portion. As a result, while the boat is traveling along the water, the water that passes along the bottom surface of the pontoon 14 and flows along the bottom surface of the pontoon 14 will substantially impact and be "blocked" and "trapped" along its rearward flow path by the wake panel 250. Thus, the wake panel 250 interrupts the flow of water and can operate to effectively cancel a portion of the wake on the side of the boat 12 where the wake panel 250 is deployed. More particularly, wake panel 250, when deployed, interrupts the cross-over effect of the wake that would otherwise cross over and interfere with the desired development of the opposite side surfable wake. This cancelling effect is effective over a short distance, mainly the prime surfable zone (e.g. 20-20 feet back from the boat 12 according to one aspect). Beyond the prime surfable zone, both sides of the boat 12 create secondary and tertiary wakes that roll with the boat 12 and may be of a size that is surfable. Thus, the wake profile 250 on the opposite side may be enhanced because the "canceled" side allows the non-cancelled side to fully develop a primary surfable wake, along with the possible further secondary and tertiary surfable wakes on one or both sides. On the non-deployed side of the boat 12, the inclined surfaces 140 creates the improvied surfable wake as previous described. Thus, it is the combination of the inclined surfaces 140 and the selective deployment of the wake panels 250 that can enhance the wake beyond the enhancement provided by the inclined surfaces 140. it will be appreciated that improved wake patterns relative to a traditional pontoon boat are possible using only the inclined surfaces 140 and without the wake panels 250 deployed, and an enhanced wake profile may also be created via the wake panels 250 used on traditional pontoons without the inclined surfaces 140. In any case, it will be appreciated that some type of wake will still be generated by the boat 12 even when a wake panel 250 is deployed, and that reference to the enhanced wake is relative to the wake that would be created without deployment of the wake panel 250.

As described above, the wake panel 250 is downwardly deployed in a sliding manner according to an aspect of the disclosure. In one aspect, the wake panel 250 slides along a set of bolts or posts 254 that are fixed to the stern end of the pontoon 14. More particularly, the posts 254 may project outwardly from the mounting rails 252. In one aspect, a plurality of posts 254 may be arranged to create a track along which the wake panel 250 may travel. In one aspect, a pair of posts may be disposed generally vertically along the mounting rails, with one post 254 disposed on or fixed in place to each mounting rails 252. A second pair of posts may be offset laterally from the first pair of posts 252, with the second pair of posts 254 attached to the mounting rails 252 in a similar manner.

Thus, in this arrangement, four posts are arranged to create two rails that are lateral offset relative to each other and define the path of travel for the wake panel 250. As shown, the rails 254 are effectively vertically aligned. However, they may also be aligned at an angle in the lateral direction to create a direction of travel of the wake panel 250 that is tilted or canted laterally inward or outward.

To travel along the posts 254, the wake panel 250 may include a pair of slots 256 defined in the wake panel 250. The slots 256 are generally parallel to each other and receive the posts 254. It will be appreciated that the number of slots 256 may generally correspond to the number of laterally spaced posts 254 that are disposed at the stern end of the pontoon 14. For example, as shown, there are two pairs of posts 254 and two slots 256. However, in another aspect, there could be three pairs of posts 254 and three slots 256. Typically, there are at least as many slots as there are groups of posts 254. For example, if there are two groups of posts 254, there could be two, three, or more slots 256, with some of the slots 256 going unused. It will be appreciated that while groups or pairs of posts 254 are described, in another aspect there a single post 254 may be disposed at a given lateral location, and an associated slot 256 may slide along the single post 254.

When the wake panel 250 is disposed in its stowed position, the posts 254 are generally arranged at a bottom end of the slot 256. In one aspect, the posts 254 may contact the bottom end of the slot 256, such that the bottom end acts a stop against upward travel of the wake panel 250. However, the stopping position of the wake panel 250 may be controlled by the travel of the associated actuator or other control mechanism.

When the wake panel 250 is translated or slides toward the deployed position, the slots 256 travel relative to the posts 254, such that the posts 254 become disposed closer to the upper end of the slots 256. The upper ends of the slots 256 may act as a stop for the amount of travel of the wake panel 250. Alternatively, the amount of deployment and the stopping position 256 may be limited or controlled by the actuator or other control mechanism.

Figure 21:
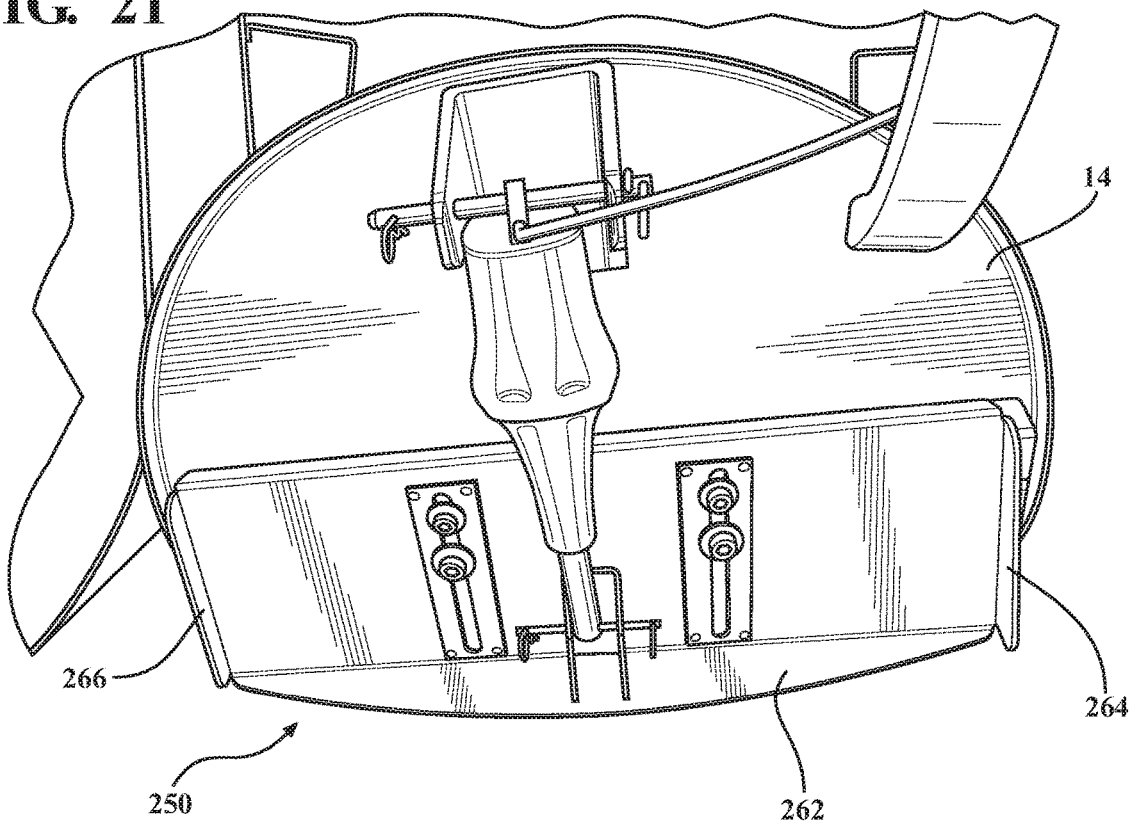
FIG. 21 illustrates a rear view of the wake panel of FIG. 16 in the retracted position.
Figure 22:
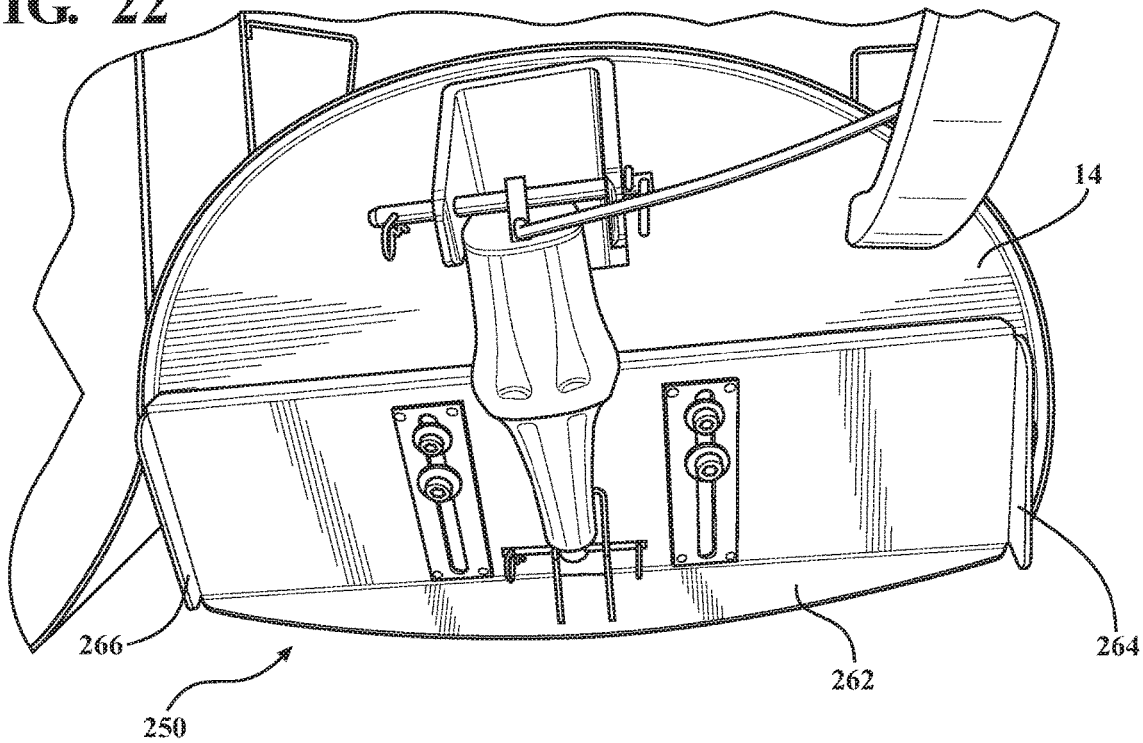
FIG. 22 illustrates a rear view of the wake panel of FIG. 21 in the deployed position.

The direction of sliding of the wake plates may be generally vertical, or it may be tilted, as described above, based on the direction of the posts 254 that the slots 256 slide along. As described previously, the inclined surface portion 140 (or flat bottom surface portion) of the pontoons may be tilted outward, such that n tilted plane of the inclined surface portion 140 is defined. The slots 256 and the posts 254 may be arranged and aligned such that the wake panel 250 slides in a direction that is generally perpendicular to the tilted plane of the inclined surface. For example, when viewed from the rear as shown in FIGS. 21 and 22, on the starboard side the slots 256 and posts 254 would be aligned to extend down and to the right, perpendicular or normal to the face of the inclined surface portion 140. when the inclined surface 140 is canted or tilted as shown and facing downward and laterally outward. Thus, in addition to moving the wake panel 250 downward when it is deployed, the wake panel 250 also moves slightly outward relative to its stowed position when the direction of travel is tilted or canted in this manner.

In one aspect, the slots 256 are generally parallel to the outboard and inboard sides of the wake panel 250, and the upper edge and lower edge of the wake panel 250 are generally perpendicular to the slots 256. Thus, when mounted and supported on the pontoon 14, the lower edge of the wake panel may be aligned with the tilted plane of the inclined surface 140.

In alternative aspect, the wake panel 250 may simply move vertically with respect to the horizontal deck of the boat 12, rather than canted or tilted, such that the sliding movement is in a direction that is at an angle relative to the laterally inclined plane of the inclined surface 140 (when the inclined surface 140 is tilted in the lateral direction with its face facing downward and outward). However, as shown, the direction of travel is inclined downward and laterally outward, when moving from the stowed position to the deployed position.

The wake panel 250 is illustrated as having a plurality of bent edge portions, however, the wake panel 250 may also be generally planar or flat at various edges relative to its body. For purposes of the discussion, the illustrated bent portions will be described.

The wake panel 250 may include a body portion 260, which covers the majority of surface area defined by the wake panel 250. The body portion 260 may be generally planar, and may include the slots 256. The body portion 260 is the portion of the wake panel 250 that generally defines the alignment plane of the wake panel 250. The body portion 260 may transition into the illustrated edges portions surrounding the body portion 260. The edge portions may be in the form of flanges extending from the body portion 260. As shown, the corners of the body portion 260 may be without bent portions, such that each bent portion or flange is separated from adjacent edge portions.

Figure 20:
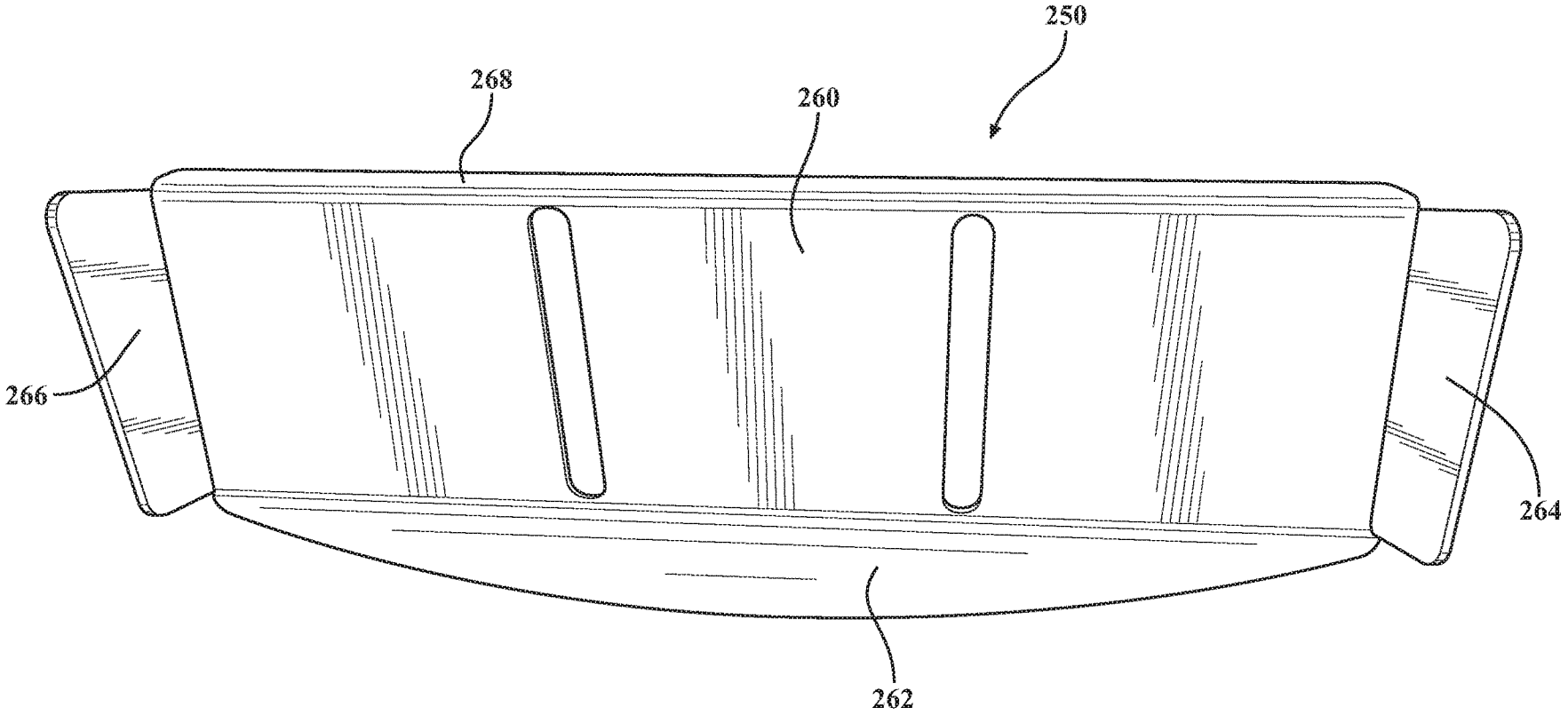
FIG. 20 illustrates the wake panel of FIGS. 16-19 for the starboard side of the boat, with the port side wake panel being a mirror image.

In one aspect, the wake panel may include a bottom edge portion 262 that is bent relative to the body portion 260. The bottom edge portion 262 extends rearwardly relative to the body portion 260. The bottom edge portion 262 may be disposed at an obtuse angle relative to the body portion 250. In one aspect, the bottom edge portion 262 may be disposed at an angle of about 135 degrees relative to the body portion 260. The bottom edge portion 262 may include a curved edge or curved profile, as shown in FIG. 20, such that laterally inboard and outboard portions of the bottom edge portion extend a smaller distance from the body portion relative to a middle portion.

When the wake panel 250 is disposed in a downwardly deployed positon, water that impacts the wake panel may flow and curl around the bottom edge portion. When the wake panel 250 is deployed in the water, the bottommost edge of the bottom edge portion 262 is disposed rearwardly relative to the bend point between the body portion 260 and the bottom edge portion 262. When the wake panel 250 is in its stowed position, it is possible in some aspects that the bottom edge portion 262 may be disposed in the water slightly when the boat 12 is traveling along the surface of the water. The rearward orientation of the bottom edge portion 262 relative to the body portion allows the water to generally flow without being substantially impeded by the slight engagement with the water flowing along the bottom of the pontoon 14.

In one aspect, the wake panel 250 may include an outboard edge portion 264, which is on the right side of the Figure for the illustrated starboard-side wake panel 250. The port side wake panel 250 would have the outboard edge on the left side. As shown in FIG. 20, the outboard edge portion 264 may be disposed at an obtuse angle of about 120 degrees relative to the body portion 260. Thus, water flowing along the side of the pontoon 14 may be directed outwardly. Water splashing along the side of the pontoon 14 may likewise be directed outwardly by the outboard edge portion 264. The outboard edge portion 264 may be described as being at an obtuse angle relative to the body portion 260 that is less than the obtuse angle of the bottom edge portion 262 relative to the body portion 260.

In one aspect, the wake panel 250 may include an inboard edge portion 266 bent and extending rearward relative to the body portion 260. In FIG. 20, the inboard edge portion 266 is shown on the left side for the illustrated starboard wake panel 250. It will be appreciated that the inboard edge portion 266 would be on the right side of the port wake panel 250.

In one aspect, the inboard edge portion 266 is bent relative to the body portion 260 at an angle of about 90 degrees, or generally perpendicular to the plane of the body portion. In one aspect, the inboard edge portion could be bent at a slight acute angle relative to the body portion 260, or at a slight obtuse angle relative to the body. When disposed in the water, the inboard edge portion 266, similar to the other edge portions, allows water that flows toward and impacts the wake panel 250 to flow and curl around the side of the wake panel 250 as the boat 12 is traveling along the surface of the water. It will be appreciated that the inboard edge portion 266 may not be exposed to as much water as the outboard edge, in particular when in the stowed position, due to the inboard edge portion being located behind the inboard side of the pontoon 14, in contrast to the outboard edge portion 264 which may encounter more splash and water flow that is present on the outboard side of the pontoon 14.

In one aspect, the wake panel 250 may include an upper edge portion 268 that is bent and extends forward relative to the body portion 260 of the wake panel 250. The upper edge portion 268 may be bent at approximately a 90 degree angle relative to the body portion. The upper edge portion 268 provides additional rigidity and stiffness to the panel, and may also operate as a stop member when the wake panel 250 is moved to the deployed position. In such an instance, the upper edge portion 268 may contact an upper surface of one of the mounting rails 252, thereby limiting further downward movement of the wake panel 250. However, as described previously, the amount of travel may be controlled by the actuator and/or control system, such that the wake panel 250 is stopped prior to contact between the upper edge portion 268 and the mounting rail 252. Moreover, with the upper edge portion 268 extending forward relative to the body portion 260, the upper edge portion 268 may be disposed out of the area of the actuator, which extends downward along the wake panel 250 for actuating the wake panel 250.

Each of the bent edge portions 262-268 provides rigidity and stiffness to the wake panel 250, defining a general "L-shape" cross section at the edges of the panel 250, with the shape of the "L" depending on the relative angle between the body portion 260 and the edge portion. The added rigidity and stiffness may limit instances of the wake panel 250 bowing or bending or flexing substantially in response to the loads and forces applied to the wake panel 250 by the water impacting against it.

Similar to previously described wake panel 150, the wake panel 250 may be selectively actuated for downward deployment on one or both sides of the boat 12. The panels 250 may be disposed on each lateral side of the boat behind each of the pontoons 14, 16 and supported by each of the pontoons 14, 16. By being arranged for selective and individual downward deployment, one wake panel 250 may be deployed while the other remains stowed. In one aspect, both may be deployed at the same time. In one aspect, the wake panels 250 may be selected to be deployed to an amount that is less than a full deployment. Accordingly, one panel may be deployed a full amount, with another being deployed a partial amount. In one aspect, a single wake panel 250 may be deployed a partial amount. It will be appreciated that various relative deployments at both sides of the boat 12 may be used.

The amount of deployment of each panel 250 relative to the other may be selected by a control system, and may be predetermined or pre-selected based on user desires. In another aspect, the amount of deployment may be manually controlled by an operator of the boat 12.

It has been found during testing that deployment of one wake panel 250 on one side of the boat 12 with the other wake panel 250 in the stowed position can result in a cleaner and more surfable wake on one side of the boat 12, with the wake on the side of the boat 12 where the wake panel 250 is deployed being spoiled or canceled to a degree that it does not substantially impact the wake created on the side of the boat 12 with the stowed wake panel 250.

In one aspect, both sides of the boat 12 may include the wake panels 150/250. In another aspect, one side of the boat 12 may include the wake panel 150/250, and the other side may be free from a wake panel. In another aspect, one side of the boat may include wake panel 150, and the other side of the boat 12 may include wake panel 250. Additionally, the inclined surfaces 140, described in detail above, may provide wake enhancement separate from the wake panels 150/250, and wake enhancement may be provided even when the wake panels 150/250 or fully retracted or only partially deployed, or even excluded. The inclined surfaces 140 may provide a substantial wake enhancement absent substantial effect provided by the wake panels 150/250. The inclined surfaces 140 may primarily form the shapeable wake, with the wake panels 150/250 operating to further shape and refine the wake. For example, as described above with reference to one of the wake panels 250 being deployed and the opposite side being stowed or only slightly deployed, a primary enhanced and surface wake is created on the side of the boat where the wake panel 250 is not deployed, and the wake panel 250 on the deployed side disrupts the wake that is created on its side, helping impart a final enhanced shape on the opposite side where the wake panel 250 was not deployed. Thus, the enhanced wake is created by the inclined surfaces 140, and the deployed wake panel 250 allows the enhanced wake on the opposite side to be formed without being disrupted by the wake coming from the deployed side, because wake on the deployed side is blocked or disrupted by the deployed wake panel 250. It will be appreciated, therefore, that wake may still be created and enhanced relative to traditional pontoons using the inclined surfaces 140, even without the additional use of the wake panels 250. And it will further be appreciated that the wake panels 250 could also be used to disrupt wake and allow wake developed on the non-deployed side to be uninterrupted for pontoons that do not include the inclined surfaces, although such a wake may not be as desirable as that which is created by pontoons having the inclined surfaces 140.

Both types of wake panels 150 and 250 may be supported by the pontoons and mounted to the pontoons 14, 16 for movement relative to the pontoons 14, 16. Both types of wake panel 150 and 250 may be configured for downward deployment into the water from a stowed position to a deployed position and configured to enhance the wake profile trailing the pontoon boat 12.

Thus, in view of the above, the system 10 may be installed on the boat 12 in the manner described above to provide the above-described benefits of increased water displacement and control of the wake produced by the boat 12 to alter the wake profile and create a more surfable wake profile. The above-described components may be used in combination with one or more of the other components affecting the wake profile. It will be appreciated that various combinations of the above-described components may be used to achieve the desired result of an improved wake profile.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A pontoon boat, comprising:

a deck;

at least two pontoon floats supporting the deck and creating trailing wakes when the boat is propelled across a body of water;

at least one wake panel supported off a stern end of at least one of the pontoon floats and slidable between a stowed positon and a deployed position for modifying at least one of the trailing wakes for water sport activities, wherein the at least one wake panel comprises at least two wake panels, and wherein the wake panels are angled forwardly in a direction from top to bottom.

2. The pontoon boat of claim 1, wherein each of the at least two pontoon floats supports an associated one of the at least two wake panels.

3. The pontoon boat of claim 1, wherein the forward angle approximates an angle of a rear face of the pontoon float on which each respective one wake panel is mounted.

4. The pontoon boat of claim 3, wherein support for the wake panels includes at least one mounting rail secured to each respective pontoon float.

5. The pontoon boat of claim 4, wherein the wake panels are slotted in the sliding direction.

6. The pontoon boat of claim 1, wherein the wake panels each have a lower edge portions formed with a respective rearward extending lower flange.

7. The pontoon boat of claim 6, wherein the lower flange forms an obtuse angle with a body portion of the respective wake panel.

8. The pontoon boat of claim 7, wherein the lower flange has a convex curved rear edge.

9. The pontoon boat of claim 7, wherein the wake panels further include outboard edge portions formed with a respective rearwardly extending outboard flange.

10. The pontoon boat of claim 9, wherein the outboard flange forms an obtuse angle with the body portion of the respective wake panel.

11. The pontoon boat of claim 10, wherein the obtuse angle of the lower flange is greater than the obtuse angle of the outboard tab.

12. The pontoon boat of claim 9, wherein the wake panels further include inboard edge portions formed with a respective rearwardly extending inboard flange.

13. The pontoon boat of claim 12, wherein the inboard flange forms an angle with the body portion of the respective wake panel that is lesser than the angle of the outboard flange, which is lesser than the angle of the lower flange.

14. The pontoon boat of claim 13, wherein the wake panels further include an upper edge portion formed with an upper flange.

15. The pontoon boat of claim 14, wherein the upper flange extends forwardly of the body portion of the respective wake panel.

16. The pontoon boat of claim 1, wherein the at least two pontoon floats have flat bottom portions adjacent the stern end thereof.

17. The pontoon boat of claim 16, wherein the flat bottom portions are tilted outwardly and defined a tilted plane.

18. The pontoon boat of claim 17, wherein the wake panels are in line with the flat bottom portions.

19. The pontoon boat of claim 18, wherein the at least two pontoons each support an associated wake panel for sliding in a direction perpendicular to the tilted plane of their respective flat bottom portions.

20. The pontoon boat of claim 19, wherein a lower edge of the wake panels are tilted and are generally parallel to the titled plane of the flat bottom portion of the pontoon floats.

21. A pontoon boat system configured to produce an improved wake profile, the pontoon boat system comprising:

first and second outer pontoons each having a front end and a rear end and extending longitudinally;

a platform separate from and coupled to and supported by the first and second outer pontoons;

wherein the first outer pontoon includes a first bottom inclined surface extending forward from the rear end of the first outer pontoon, wherein a front end of the first bottom inclined surface is disposed below a rear end of the first bottom inclined surface;

wherein the second outer pontoon includes a second bottom inclined surface extending forward from the rear end of the second pontoon, wherein a front end of the second bottom inclined surface is disposed below a rear end of the second bottom inclined surface;

wherein, at the rear end of the first and second outer pontoons outer pontoon, a laterally inner surface of the first outer pontoon is spaced away from a laterally inner surface of the second outer pontoon at a smaller distance relative to the front end of the first and second outer pontoons.

22. The system of claim 21, further comprising a pair of wake panels mounted and supported on a rear end of the first and second outer pontoons, wherein the wake panels are mounted for independently actuatable pivotable or slidable translation between a stowed position and a downwardly deployed position, wherein the wake panels are disposed below the surface of the water when the pontoon boat is traveling forward along the water when the wake panels are in the downwardly deployed position.

23. The system of claim 21 further comprising a center pontoon disposed laterally between the first and second outer pontoons and extending longitudinally between a front end and a rear end thereof;

wherein, at the rear end of the first outer pontoon, a laterally inner surface of the first outer pontoon is spaced away from a first laterally outer surface of the center pontoon at a smaller distance relative to the front end of the first outer pontoon;

wherein, at the rear end of the second outer pontoon, a laterally inner surface of the second outer pontoon is spaced away from a second laterally outer surface of the center pontoon at a smaller distance relative to the front end of the second outer pontoon.

24. The boat of claim 21, further comprising an inboard/outboard forward drive motor.

25. The system of claim 23, wherein the first and second outer pontoons are wider at the rear end than the front end and the center pontoon is wider at the rear end than at the front end.

26. A method of varying a wake profile of a pontoon boat, the method comprising:

propelling a pontoon boat having two outer pontoon floats that support a separate platform;

positioning wake panels attached to the two outer pontoon floats which are each moveable between a downwardly deployed position and an upwardly retracted position;

operating the pontoon boat in a first state in which the at least one of the wake panels is positioned in the downwardly deployed position;

generating a first wake profile when operating the pontoon boat in the first state;

positioning the wake panels in a retracted position in which the wake panels are raised relative to the deployed state;

operating the pontoon boat in a second state in which both wake panels are positioned in the retracted position;

generating a second wake profile when operating the pontoon boat in the second state, wherein the second wake profile is reduced relative to the first wake profile, and wherein the pontoon floats are each tubular and have generally flat bottom inclined surfaces at their aft ends which are tilted upwardly and outwardly.

27. The method of claim 26, wherein one of the wake panels is in the deployed position and one of the wake panels is in the retracted position when operating in the first state.

* * * * *